US006130681A

United States Patent [19]

Ando

[11] Patent Number: 6,130,681

[45] Date of Patent: Oct. 10, 2000

[54] PRINTER DEVICE

[75] Inventor: Makoto Ando, Tokyo, Japan

[73] Assignee: Sony Corporation, Tokyo, Japan

[21] Appl. No.: 09/035,967

[22] Filed: Mar. 6, 1998

[30] Foreign Application Priority Data

Mar. 7, 1997 [JP] Japan ..... 9-053702

[51] Int. Cl.[7] ..... B41J 2/205

[52] U.S. Cl. ..... 347/15; 347/21; 347/48; 347/100

[58] Field of Search ..... 347/15, 7, 21, 347/48, 100

[56] References Cited

U.S. PATENT DOCUMENTS 5,777,636 7/1998 Naganuma et al. ..... 347/10
5,980,014 11/1999 Kagami ..... 347/15

FOREIGN PATENT DOCUMENTS 0 655 337 A2 5/1995 European Pat. Off. .

OTHER PUBLICATIONS

Patent Abstracts of Japan, vol. 18, No. 411, Aug. 2, 1994 (Sony Corp.) & JP 06 122201 A, May 6, 1994.
Patent Asbtracts of Japan, vol. 18, No. 317, Jun. 16, 1994 (Sony Corp.) & JP 06 071901 A, Mar. 15, 1994.
Patent Abstracts of Japan, vol. 97, No. 6, Jun. 30, 1997 (Sony Corp.) & JP 09 048140 A, Feb. 18, 1997.
Patent Abstracts of Japan, vol. 97, No. 6, Jun. 30, 1997, (Sony Corp.) & JP 09 052378 A, Feb. 25, 1997.
Patent Abstracts of Japan, vol. 18, No. 317, Jun. 14, 1994 (Sony Corp.) & JP 06 071881 A, Mar. 15, 1994.

*Primary Examiner*—Richard Moses
*Attorney, Agent, or Firm*—Hill & Simpson

[57] ABSTRACT

A printer device for realizing correct representation of the gradation. After oozing a quantitation medium 45 from a quantitation medium nozzle 53, the printer device causes an emission medium 49 from an emission medium nozzle 54 for mixing with the quantitation medium 45 for emitting the resulting mixed liquid. During the time which elapses since emission of the quantitation medium 45 from the quantitation medium nozzle 53 until reversion of the liquid surface of the quantitation medium 45 to the opening end of the quantitation medium nozzle 53, the quantitation medium 53 is pressurized in a direction of pulling the liquid surface of the quantitation medium 45 into the quantitation medium nozzle 53. Also, during the time which elapses since the emission of the emission medium 49 from the emission medium nozzle 54 until reversion of the liquid surface of the emission medium 49 to the opening end of the emission medium nozzle 54, the emission medium 49 is pressurized in a direction of pulling the liquid surface of the emission medium 49 into the emission medium nozzle 54.

4 Claims, 22 Drawing Sheets

PRINTER DEVICE

BACKGROUND OF THE INVENTION

1. Field of the Invention

This invention relates to a printer device for emitting a printer device for mixing a medium for quantitation and a medium for emission and emitting the resulting mixed mediums. More particularly, it relates to a printer device in which the pressure applied to at least one of the medium for quantitation and the medium for emission for enabling correct gradation representation.

2. Description of the Related Art

Recently, computerized document preparation, termed desk publishing, has become popular particularly in an office, such that an increasing demand is raised for outputting not only letters or figures but also colored natural images, such as photos, along with the letters or figures. In keeping up therewith, it is required to have a natural image printed to a high quality such that gradation representation by regeneration of a half tone is becoming crucial. On the other hand, a so-called on-demand type printer device, which emits ink droplets only when required for effecting printing on a recording material, such as paper sheets or films, responsive to printing signals, is being used in increasing numbers because it can be reduced in size and cost.

Among a variety of methods for emitting the ink droplets, a method employing a piezoelectric device and a device employing a heat emitting device are most popular. The former method applies a pressure to the ink by deformation of the piezoelectric device for emitting the ink, while the latter method heats and vaporizes the ink by the heating device for generating bubbles for pressurizing and emitting the ink.

There are a variety of methods proposed for virtually realizing the above-mentioned gradation representation by manifesting the half-tone with the above-mentioned on-demand type printer device emitting the ink liquid droplets. The first of these varies the voltage or pulse width of voltage pulses applied to the piezoelectric device or the heating device for controlling the size of the emitted liquid drop to vary the diameter of the printing dots for representing the gradation.

However, with this method, the ink becomes unable to be emitted if the voltage or the pulse width applied to the piezoelectric device or the heating device is lowered excessively. Thus, there is a limitation to the minimum liquid drop size such that the number of stages of the gradation that can be represented is only small. In particular, the low concentration cannot be represented with ease such that the natural image cannot be printed out satisfactorily.

The second method is to construct a pixel of an image by a matrix of, for example, 4×4 dots, without varying the dot diameter, and to represent the gradation by picture processing such as the so-called dither method or the error diffusion method on the matrix basis.

With this second method, 17 stages of the concentration can be represented if each pixel is constructed by 1 4×4 matrix. However, if this second method is used for printing with the same dot density as that in the first method, the resolution is one-fourth of that of the first method such that an extremely coarse image is produced. Thus, this second method is insufficient for printing out the natural image.

For overcoming the problems of the conventional on-demand printer device as a principle, the present inventors have proposed a printer device in which the ink and a dilution liquid as a transparent solvent are mixed at a pre-set mixing ratio directly before emission to give a diluted ink which is then immediately emitted at a nozzle for deposition on a recording support to effect printing, as disclosed in, for example, the Japanese Laying-Open Patent H-5-201024 and H-7-195682. The system of this type in which the ink is the quantitation medium and the dilution liquid is the emission medium, the ink as the quantitation medium is mixed with the dilution liquid as the emission medium to give a diluted ink and the emission medium is emitted to effect recording, is termed a 'carrier jet' system. In the above printer device, no problem is raised if the dilution liquid is the quantitation medium and the ink is the emission medium.

In such 'carrier jet' printer device, the quantity of the quantitation medium, which is the ink or the dilution liquid, can be varied to vary the mixing ratio between the ink and the dilution liquid to control the concentration of the emitted mixed solution to vary the concentration from one printed dot to another. Thus it becomes possible to print out a natural image replete with the half tone gradation without deterioration in resolution.

The above-described two liquid mixing type printer device may, for example, be a so-called inner mixing type printer device. This inner mixing type printer device at least has an emission medium pressurizing chamber charged with the emission medium, an emission medium nozzle communicating with the emission medium pressurizing chamber, a quantitation medium pressurizing chamber into which is introduced the quantitation medium, and a connecting portion for connecting the quantitation medium pressurizing chamber to the emission medium nozzle. The quantitation medium in the quantitation medium pressurizing chamber is mixed with the emission medium in the emission medium nozzle via the connecting portion and the quantitation medium is mixed with the emission medium in the emission medium nozzle to form a mixed solution which is emitted at the emission medium nozzle.

However, in the above-described inner mixing type printer device, the quantitation medium tends to be diffused into the emission medium in the emission medium nozzle during the operation stand-by time when the quantitation medium is not mixed with the emission medium. In addition, the emission medium is likely to flow unnecessarily into the connecting portion during mixing-emission of the quantitation medium and the emission medium, or the quantitation medium is likely to flow unnecessarily into the emission medium.

If such diffusion between the quantitation medium and the emission medium occurs, the dilution liquid as the emission medium is gradually colored, or the quantitation medium, such as the ink, is diluted, thus affecting the concentration of the emitted mixed liquid droplets to render it difficult to obtain the correct gradation in concentration.

The above-mentioned unnecessary inflow is produced by the fact that, if a mixed solution of the ink as the quantitation medium and the dilution liquid as the emission medium, having an extremely thin concentration, is emitted continuously, the dilution liquid is intruded under pressure gradually into the ink-supplying connecting portion, or that, if the above mixed solution having a thick concentration is emitted continuously, the ink is intruded under pressure gradually into the emission medium nozzle. In case of unnecessary inflow in the former case, the mixed liquid droplets of a thin concentration are emitted when next the mixed solution of the thick concentration is desired to be emitted, whereas, in case of unnecessary inflow in the former case, the mixed liquid droplets of a thick concentration are emitted when next the mixed solution of the thin concentration is desired to be emitted, to render it difficult to realize correct concentration gradation.

Thus, in a conventional printer device, a unidirectional valve, prepared by, for example, electro-casting, is provided in a boundary between the connecting portion supplying the quantitation medium and the emission medium nozzle to prevent diffusion of the quantitation medium and the emission medium during the emission stand-by time as well as to prevent inflow between the two mediums during the mixing emission operation.

However, it is not that easy with the above-mentioned unidirectional valve to realize complete isolation between the two mediums during the emission stand-by time or complete prevention of the inflow between the two mediums during the mixing emission operation to render it difficult to realize correct concentration gradation. Moreover, such unidirectional valve leads inevitably to increased production cost to lower the productivity.

In order to evade such inconvenience, a so-called external mixing type printer device has also been proposed. This printer device has a quantitation medium pressurizing chamber into which a quantitation medium is introduced and an emission medium pressurizing chamber into which an emission medium is introduced, with a quantitation medium nozzle communicating with the quantitation medium pressurizing chamber and an emission medium nozzle communicating with the emission medium pressurizing chamber being opened in adjacency to each other. The quantitation medium is extruded towards the emission medium nozzle from the quantitation medium nozzle along the nozzle opening surface and brought into contact with the emission medium charged in the vicinity of the distal end of the emission medium nozzle to form a mixed solution. The emission medium then is emitted via the emission medium nozzle for externally mixing the quantitation medium and the emission medium to emit the resulting mixed solution at an outside.

Since the quantitation medium nozzle is formed separately from the emission medium nozzle, there is no risk of diffusion of the quantitation medium and the emission medium during emission stand-by time or inflow of the two mediums during the mixing and emission operation.

In the above-described printer device for mixing the ink as the quantitation medium and the dilution liquid as the emission medium and for emitting the resulting mixture, the mixing ratio between the ink and the dilution liquid needs to be controlled correctly for correct representation of the gradation corresponding to image data. In the above-described external mixing type printer device, the ink and the dilution liquid can be separated from each other in the state in which the ink and the dilution liquid are not as yet mixed together, that is in the emission stand-by state.

However, in this external mixing type printer device, there are occasionally presented problems that, when the liquid surface of the emission medium reverts to the opening end of the emission medium nozzle after mixing and emission, the emission medium overflows the emission medium nozzle to flow into the quantitation medium nozzle, or the liquid surface of the quantitation medium after mixing and emission overflows the quantitation medium nozzle due to reaction to the quantitation operation to flow into the emission medium nozzle.

In case of such relative inflow of the ink and the dilution liquid, the mixing ratio between the ink and the dilution liquid for the next dot is affected to render it impossible to represent the gradation correctly to render generation of the high-quality recording image difficult.

SUMMARY OF THE INVENTION

It is therefore an object of the present invention to provide a printer device in which relative interference between the quantitation medium and the emission medium after mixing and emission is prohibited to render it possible to mix the quantitation medium and the emission medium in correct amounts corresponding to the gradation to realize correct gradation representation.

The present invention provides a printer device of the type including an emission medium pressurizing chamber charged with an emission medium, a quantitation medium pressurizing chamber charged with a quantitation medium, an emission medium nozzle communicating with the emission medium pressurizing chamber, a quantitation medium nozzle communicating with the quantitation medium pressurizing chamber, and a printer head adapted for oozing the quantitation medium from the quantitation medium nozzle towards the emission medium nozzle and subsequently for emitting the emission medium from the emission medium nozzle for mixing the quantitation medium and the emission medium together for emitting the resulting mixed solution. The emission medium nozzle and the quantitation medium nozzle are opened in adjacency to each other. According to the present invention, the quantitation medium is pressurized in a direction of pulling the liquid surface of the quantitation medium into the quantitation medium nozzle during the time which elapses since emission of the quantitation medium from the quantitation medium nozzle until reversion of the liquid surface of the quantitation medium to an opening end of the quantitation medium nozzle.

In the printer device according to the present invention, in which, during the time which elapses since emission of the quantitation medium from the quantitation medium nozzle until reversion of the liquid surface of the quantitation medium to the opening end of the quantitation medium nozzle, the quantitation medium is pressurized in a direction of pulling the liquid surface of the quantitation medium into the quantitation medium nozzle, the liquid surface of the quantitation medium can be prevented from overflowing the quantitation medium nozzle after emission of the mixed liquid due to reaction to the quantitation operation to flow into the emission medium nozzle. It becomes possible in this manner to mix a correct amount of the quantitation medium in meeting with the gradation into the emission medium.

Also, in the printer device according to the present invention in which, during the time which elapses since emission of the emission medium from the emission medium nozzle until reversion of the liquid surface of the emission medium to an opening end of the emission medium nozzle, the emission medium is pressurized in a direction of pulling the liquid surface of the emission medium into the emission medium nozzle.

In the printer device according to the present invention, in which, during the time which elapses since emission of the emission medium from the emission medium nozzle until reversion of the liquid surface of the emission medium to the opening end of the emission medium nozzle, the emission medium is pressurized in a direction of pulling the liquid surface of the emission medium into the emission medium nozzle, the liquid surface of the emission medium can be prevented from overflowing the emission medium nozzle after emission of the mixed liquid to flow into the quantitation medium nozzle to render it possible to mix a correct amount of the emission medium in meeting with the gradation with the quantitation medium.

Thus, with the printer device of the present invention, the quantitation medium and the emission medium can be mixed together in correct amounts in meeting with the gradation.

Stated differently, with the printer device of the present invention, the quantitation medium is pressurized in the direction of pulling the liquid surface of the quantitation medium into the inside of the quantitation medium nozzle during the time which elapses since emission of the quantitation medium from the quantitation medium nozzle until reversion of the liquid surface of the quantitation medium to the opening end of the quantitation medium nozzle, thereby preventing the quantitation medium from flowing from the quantitation medium nozzle into the emission medium.

Also, with the printer device of the present invention, the emission medium is pressurized in the direction of pulling the liquid surface of the emission medium into the inside of the emission medium nozzle during the time which elapses since emission of the emission medium from the emission medium nozzle until reversion of the liquid surface of the emission medium to the opening end of the emission medium nozzle, thereby preventing the emission medium from flowing from the emission medium nozzle into the quantitation medium.

That is, the quantitation medium and the emission medium can be prevented from mixing together unnecessarily after emission of the mixture of the quantitation medium and the emission medium to enable mixing of the quantitation medium and the emission medium in correct amounts in keeping with the gradation to enable correct representation of the gradation to realize a high-quality recorded image.

DESCRIPTION OF PREFERRED EMBODIMENTS

Figure 1:
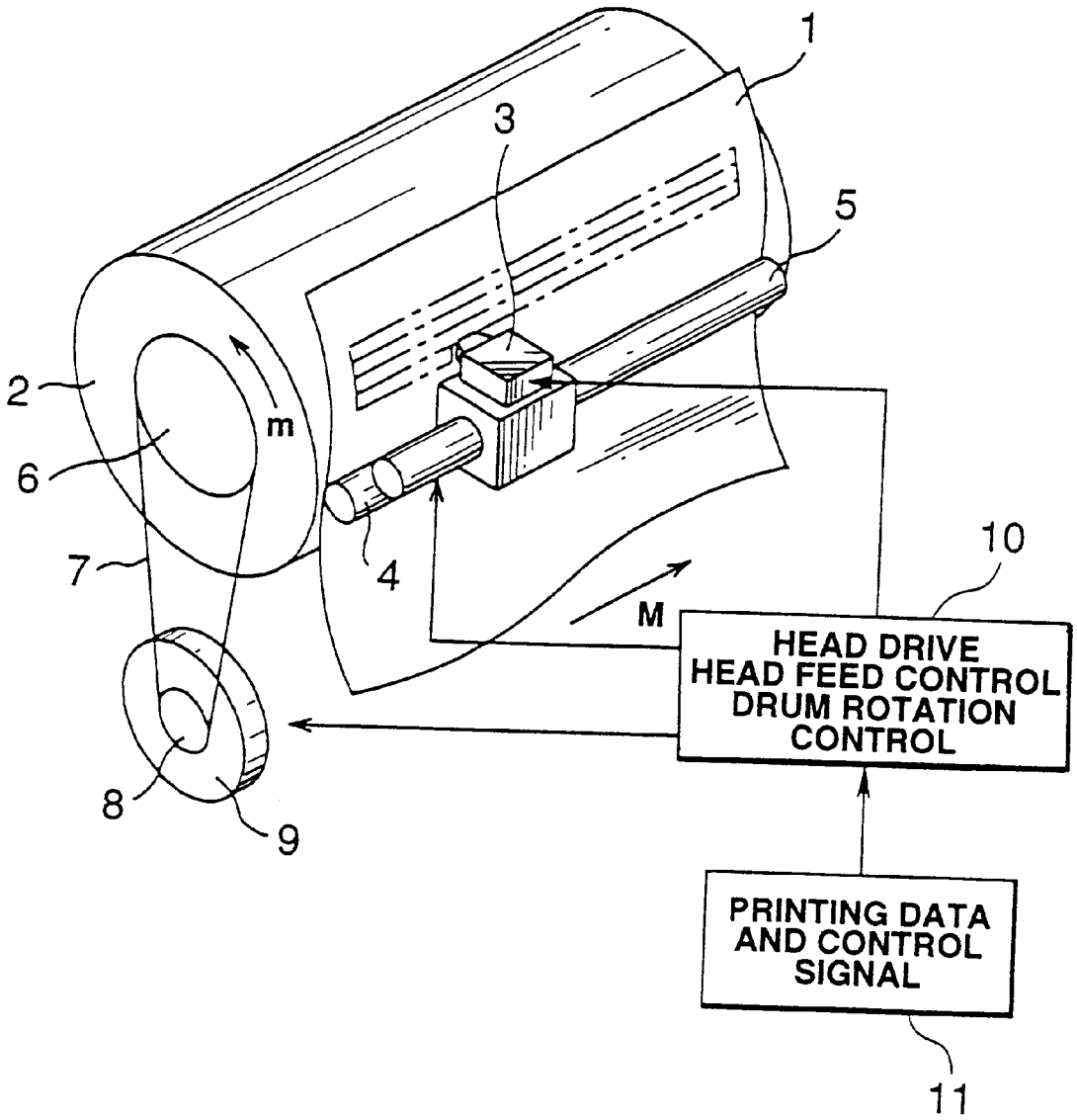
FIG. 1 is a schematic perspective view showing essential portions of a typical printer device according to the present invention.

Referring to the drawings, preferred embodiments of the present invention will be explained in detail. The following description is made of a so-called 'carrier jet' type printer device in which the ink and the dilution liquid are used as the quantitation medium and the emission medium, respectively.

The printer device according to the present invention is a so-called serial type printer device mainly comprised of a drum 2 supporting a printing paper sheet 1 as a printing support and a printer head 3 used for recording on the printing paper sheet 1.

The printing paper sheet 1 is held by being pressed against the drum 2 by a paper sheet pressing roll 4 mounted parallel to the axis of the drum 2. A feed screw 5 is mounted parallel to the axis of the drum 2 in the vicinity of the outer periphery of the drum 2. The printer head 3 is held by this feed screw 5. That is, the printer head 3 is moved axially of the drum 2, as indicated by arrow M, by rotation of the feed screw 5.

On the other hand, the drum 2 is run in rotation by a motor 9 via a pulley 6, a belt 7 and another pulley 8 as indicated by arrow M. The rotation of the feed screw 5 and the motor 9 and the printer head 3 are driving-controlled by the head drive, head feed control and a drum rotation control unit 10 based on printing data and a control signal 11.

In the above construction, if the printer head 3 is moved to perform letter printing for one row, the drum 2 is rotated by one row to effect letter printing of the next row. The head 3 is moved for letter printing in one direction or in reciprocating directions.

Figure 2:
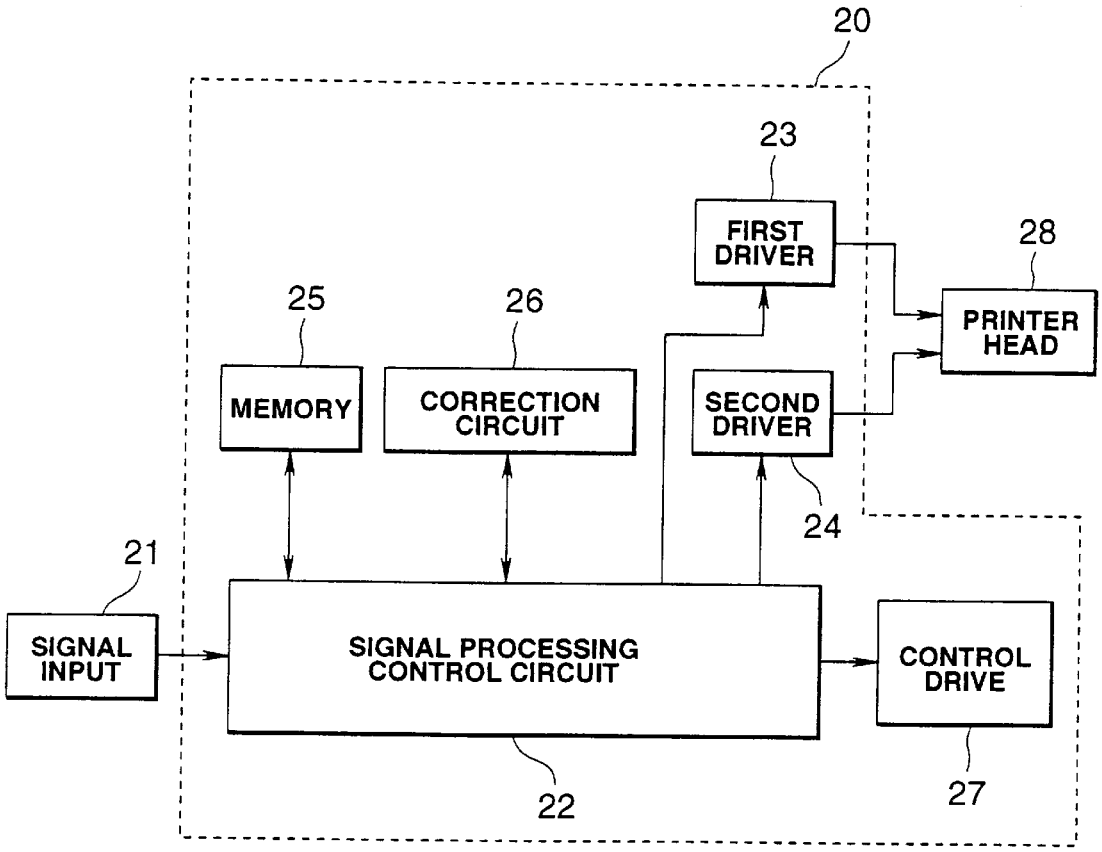
FIG. 2 is a block diagram of a letter printing and control system of a typical printer device according to the present invention.

FIG. 2 shows a block diagram of the letter printing and control system in the above-described printer device. The printer device is controlled by a controller 20 shown in FIG. 2. The controller 20 is made up of a signal processing control circuit 22, a first driver 23, a second driver 24, a memory 25, a correction circuit 26 and a driving controller 27. The signal processing control circuit 22 is of a CPU or DSP (digital signal processor) configuration.

A number of the first drivers 23 corresponding to the number of the quantitation medium nozzles and a number of the second drivers 24 corresponding to the number of the emission medium nozzles are provided, respectively. The first driver 23 driving-controls a first layered piezoelectric device, as later explained, operating as first pressure control means, provided for extruding the quantitation medium from a quantitation medium nozzle. The second driver 24 driving-controls a second layered piezoelectric device, as later explained, operating as second pressure control means provided for extruding the emission medium from an emission medium nozzle. One of the quantitation side and the emission side is the ink, with the other being the dilution liquid.

The first and second drivers 23, 24 driving-control the first and second pressure control means based on a serial-to-parallel conversion circuit and a timing control circuit, provided in the signal processing control circuit 22, respectively.

Input signals 21, such as letter printing data, signals of an operation unit or external control signals, enter the signal processing control circuit 22 of the controller 20, and sorted in the printing sequence by the signal processing control circuit 22. The sorted signals are sent via the first and second drivers 23, 24 along with emission signals to a print head 28 to control the print head 28. Since the letter printing sequence differs with different structures of the print head 28 and the letter printing units and also with the inputting sequence of the letter printing data, the sorted signals are temporarily stored, if need be, in a line buffer memory or a field memory for later use.

If the printer head is a multi-nozzle head such that there are an extremely large number of nozzles, the number of interconnections mounted on the print head 28 is decreased by loading an IC on the print head 28. To the signal processing control circuit 22 is connected a correction circuit 26 configured for γ correction and color correction in case of color printing and for correction fluctuations of the print heads. In the correction circuit 26 are stored pre-set correction data in the form of a ROM (read-only memory) map so as to be fetched depending on external conditions, such as nozzle number, temperature or input signals.

The signal processing control circuit 22 usually performs processing as the CPU or DSP configurations as described above. The processed signals are sent to a control driving unit 27, which then performs control for driving or synchronizing a motor designed to run the drum and the feed screw in rotation, cleaning the head and supplying or discharging the printing paper sheets. Of course, the signals mean not only letter printing data but signals of the operation unit or external control signals as well.

Figure 3:
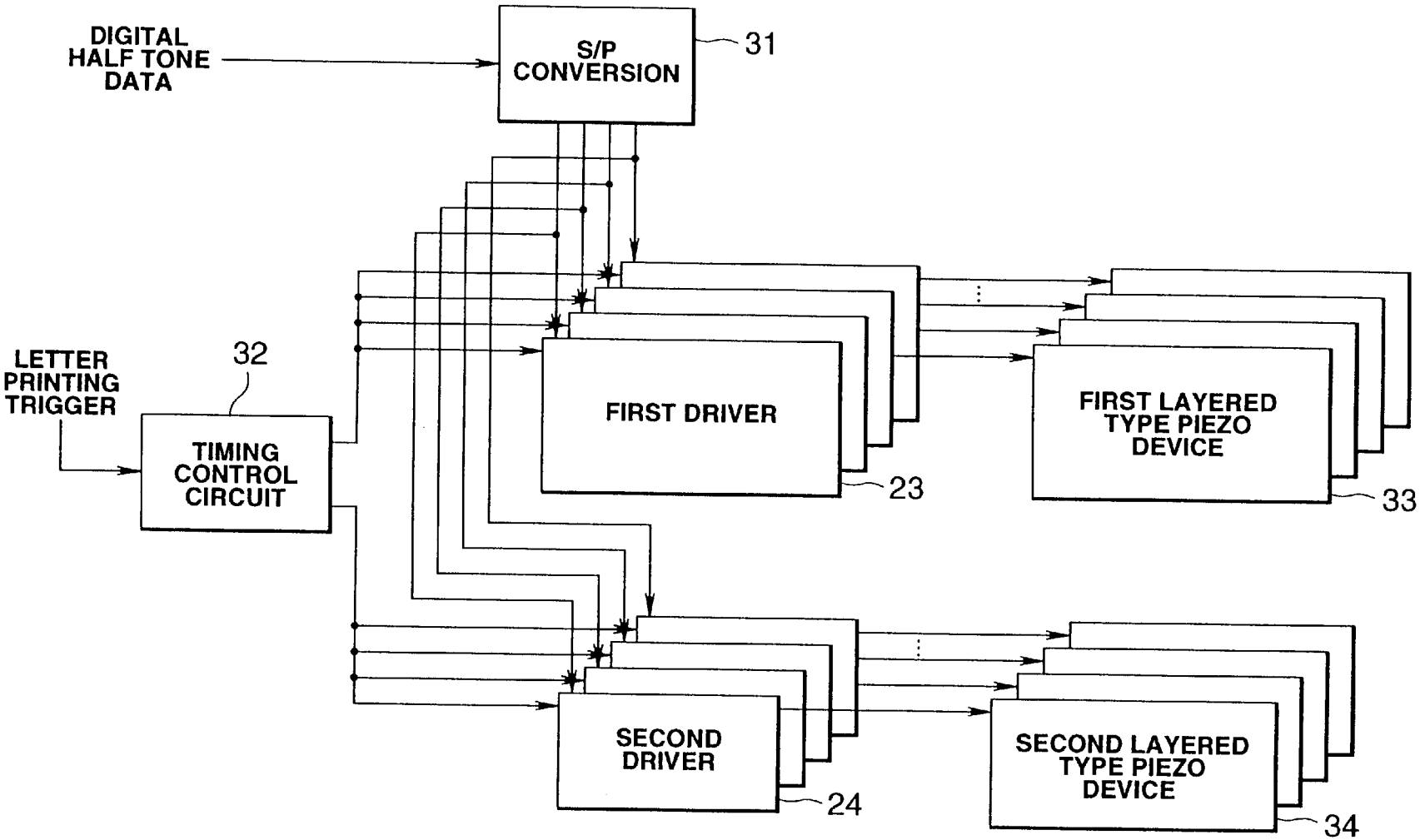
FIG. 3 is a block circuit diagram showing a driving circuit of a printer head of a typical printer device according to the present invention.

FIG. 3 shows a driving circuit for the print head. Specifically, digital half-tone data are furnished from another block and supplied by a serial-to-parallel conversion circuit 31 to the first and second drivers 23, 24. If the digital half-tone data supplied from the serial-to-parallel conversion circuit 31 is not larger than a pre-set threshold value, quantitation or emission is not carried out. At a letter printing timing, a letter printing trigger is outputted by another block so as to be detected by a timing control circuit 32 in order to output the quantitation unit control signal and the emission control signal at a pre-set timing to the first and second drivers 23, 24, respectively.

Figure 4:
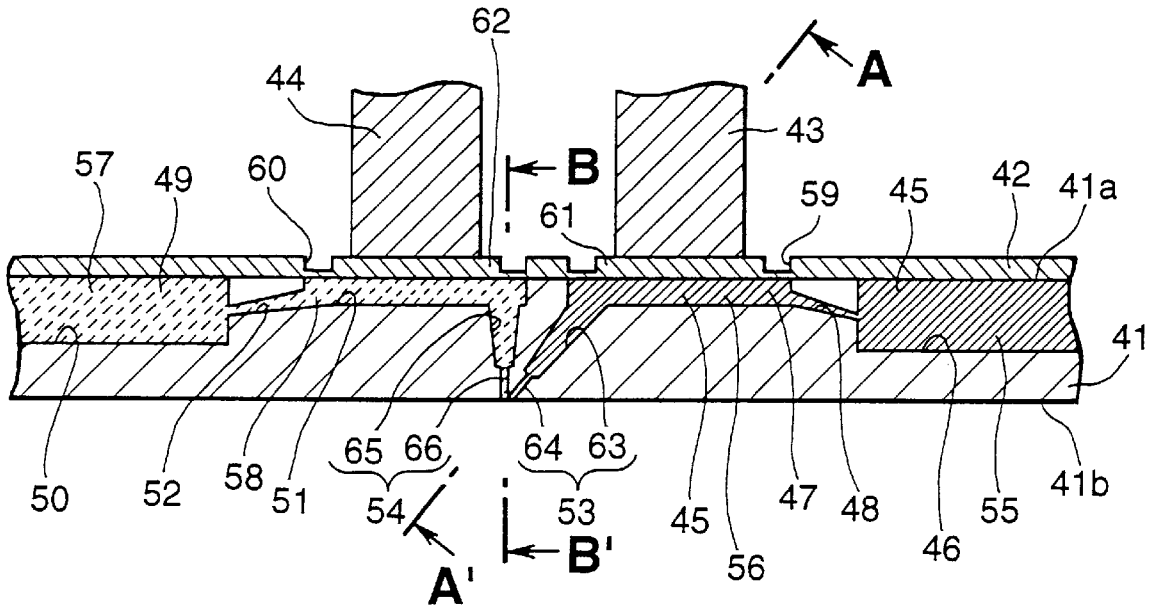
FIG. 4 is a schematic cross-sectional view showing essential portions of a printer head of a typical printer device according to the present invention.

The print head of the printer device according to the present invention is hereinafter explained. The print head of the printer device of the instant embodiment is mainly comprised of a nozzle plate 41, a vibration plate 42 and pressure generating means, as shown in FIG. 4. The pressure generating means, herein used, is comprised of a first layered piezoelectric device 43 and a second layered piezoelectric device 44.

The nozzle plate 41 is formed of resin. The nozzle plate 41 is formed with a first recess 46 and a second recess 47 which are opened in a major surface 41*a* towards the vibration plate 42. The first recess 46 delimits a quantitation medium liquid chamber supplied with the quantitation medium 45, which is the ink, while the second recess 47 delimits a quantitation medium liquid chamber charged with the quantitation medium 45. There is formed a first conduit 48 interconnecting the lateral surface of the first recess 46 and the lateral surface of the second recess 47 and which is formed as a substantially in-plane through-hole.

Also, the nozzle plate 41 is formed with a third recess 50 and a fourth recess 51 which are opened in a major surface 41*a* towards the vibration plate 42. The third recess 50 delimits an emission medium liquid chamber supplied with the emission medium 45 which is the ink, while the fourth recess 51 delimits an emission medium liquid chamber charged with the emission medium 49. There is formed a second conduit 52 interconnecting the lateral surface of the third recess 50 and the lateral surface of the fourth recess 51 and which is formed as a substantially in-plane through-hole.

The nozzle plate 41 is also formed with a quantitation medium nozzle 53 and an emission medium nozzle 54. The quantitation medium nozzle 53 is a through-hole formed from the bottom surface of the second recess 47 to a major surface 41*b* on the opposite side to the vibration plate 42 for extending obliquely relative to the direction of thickness of the nozzle plate 41, while the emission medium nozzle 54 is a through-hole formed from the bottom surface of the fourth recess 51 to the major surface 41*b* on the opposite side to the vibration plate 42 for extending obliquely relative to the direction of thickness of the nozzle plate 41.

Figure 5:
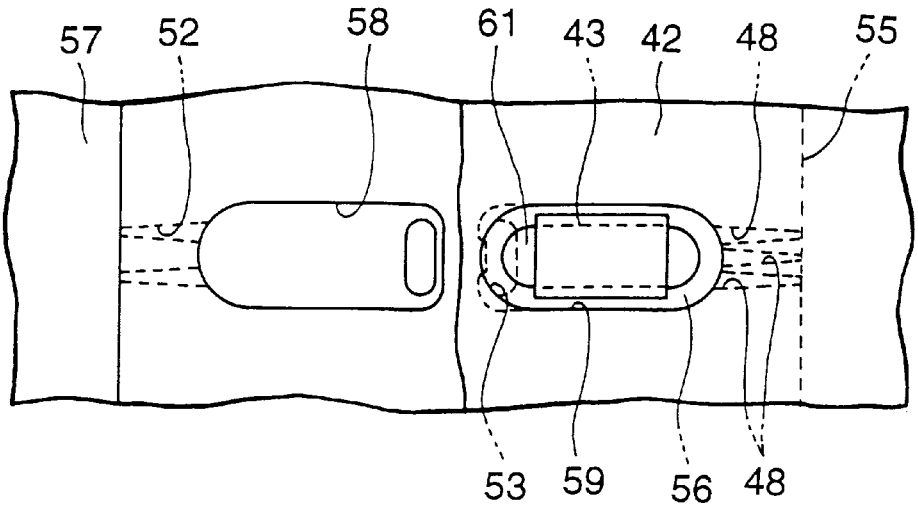
FIG. 5 is a schematic plan view showing essential portions of a printer head of a typical printer device according to the present invention.

Thus, by arranging the vibration plate 42 for stopping the above recesses on a major surface 41*a* of the nozzle plate 41, the spacing sandwiched between the first recess 46 and the vibration plate 42 serves as a quantitation medium liquid chamber 55, while the spacing sandwiched between the second recess 47 and the vibration plate 42 serves as a quantitation medium pressure chamber 56. As also shown in FIG. 5, the quantitation medium liquid chamber 55, first conduit 48, quantitation medium pressure chamber 56 and the quantitation medium nozzle 53 are formed for delimiting a continuous spacing FIG. 5 shows, in a plan view, the state in which the first layered piezoelectric device 43 on the quantitation medium side is arranged and the state of the nozzle plate 41 on the emission medium side looking from the major surface 41*a* of the nozzle plate 41.

The spacing delimited by the third recess 50 and the vibration plate 42 serves as an emission medium liquid chamber 57, while the spacing delimited between the fourth recess 51 and the vibration plate 42 serves as an emission medium pressure chamber 58. The emission medium liquid chamber 57, second conduit 52, emission medium pressure chamber 58 and the emission medium nozzle 54 are formed for delimiting a continuous spacing, as also shown in FIG. 5.

In the vibration plate 42, an annular recess 59 is formed at an outer rim portion thereof in register with the quantitation medium pressure chamber 56, while a similar annular recess 60 is formed at an outer rim portion thereof in register with the emission medium pressure chamber 58, as shown in FIG. 4. Therefore, if the vibration plate 42 is viewed from above, a projection 61 is formed in register with the quantitation medium pressure chamber 56 as shown on the quantitation side of FIG. 5 and the first layered piezoelectric device 43 is formed thereon. This applies for the emission side. That is, a projection 62 is formed in an inner area surrounded by the recess 60, and the second layered piezoelectric device 44 is formed thereon, as shown in FIG. 4.

In the printer head 3 of the printer device according to the present invention, the quantitation medium nozzle 53 is formed for extending obliquely relative to the direction of thickness of the nozzle plate 41, as described above, while the emission medium nozzle 54 is formed along the direction of thickness of the nozzle plate 41, similarly as described above. The quantitation medium nozzle 53 is designed to approach to the emission medium nozzle 54 as the major surface 41*b* is approached. The nozzle openings are adjacent to each other in the major surface 41*b* which is to be the nozzle opening surface. The angle between the centerlines of the quantitation medium nozzle 53 and the emission medium nozzle 53 is 30°.

Figure 6:
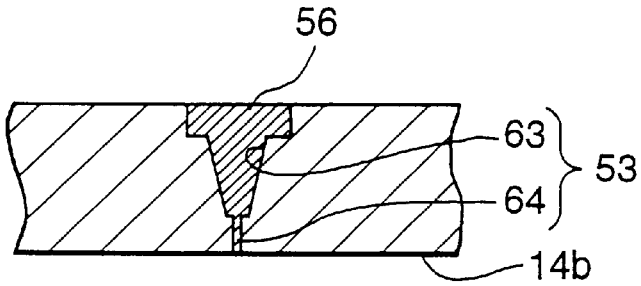
FIG. 6 is a schematic cross-sectional view showing essential portions of the vicinity of a quantitation medium nozzle of a printer head of a typical printer device according to the present invention.

Referring to FIG. 6, which shows a cross-section taken along line A–A' of FIG. 4, the quantitation medium nozzle 53 is comprised of a first taper nozzle portion 63 and a first nozzle portion 64. The first taper nozzle portion 63 is progressively narrower in width in a direction proceeding from the bottom surface of the quantitation medium pressure chamber 56 towards the major surface 41*b*, while the first nozzle portion 64 is formed in continuation to the distal end of the first taper nozzle portion 63 and operates as a virtual nozzle.

Figure 7:
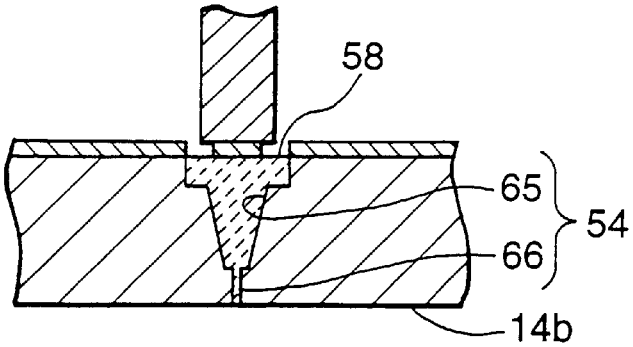
FIG. 7 is a schematic cross-sectional view showing essential portions of the vicinity of an emission medium nozzle of a printer head of a typical printer device according to the present invention.

Referring to FIG. 7, which shows a cross-section taken along line B–B' of FIG. 4, the emission medium nozzle 54 is comprised of a second taper nozzle portion 65 and a second nozzle portion 66. The second taper nozzle portion 65 is progressively narrower in width in a direction proceeding from the bottom surface of the quantitation medium pressure chamber 58 towards the major surface 41*b*, while the second nozzle portion 66 is formed in continuation to the distal end of the second taper nozzle portion 65 and operates as a virtual nozzle.

By providing the first taper nozzle portion 63 and the second taper nozzle portion 65, the flow path resistance is lowered in the quantitation medium nozzle 53 and in the emission medium nozzle 54 to realize smooth liquid flow. In particular, the effect of preventing air bubbles from being left over at the time of initially charging the ink and the dilution liquid is outstanding.

The ink as the quantitation medium 45 is charged from a quantitation medium tank, not shown, via the quantitation medium liquid chamber 55, first conduit 48 and quantitation medium pressure chamber 56 into the quantitation medium nozzle 53.

The dilution liquid as the emission medium 49 is charged from an emission medium tank, not shown, via the emission medium liquid chamber 57, second conduit 52 and the emission medium pressure chamber 58 into the emission medium nozzle 54.

In the printer head 3 of the printer device of the instant embodiment, the major surface 41*b*, serving as the nozzle opening surface of the nozzle plate 41, is processed with liquid repellant processing for preventing wetting of the quantitation medium nozzle 53 and the emission medium nozzle 54 on the major surface 41*b* by the ink or the dilution liquid to improve stability of emission of liquid droplets and precision in the emitting direction.

With the printer head 3 of the printer device of the instant embodiment, the opening of the quantitation medium nozzle 53 is shaped so as to have a cut-out towards the emission medium nozzle 54.

Stated differently, the opening of the quantitation medium nozzle 53 is shaped so that the minimum distance between the center of an inscribed circle of the opening of the quantitation medium nozzle 53 and the edge of the opening of the emission medium nozzle 54 will be larger than the minimum distance between the center of a circumscribed circle of the opening of the quantitation medium nozzle 53 and the opening edge of the emission medium nozzle 54.

Figure 8:
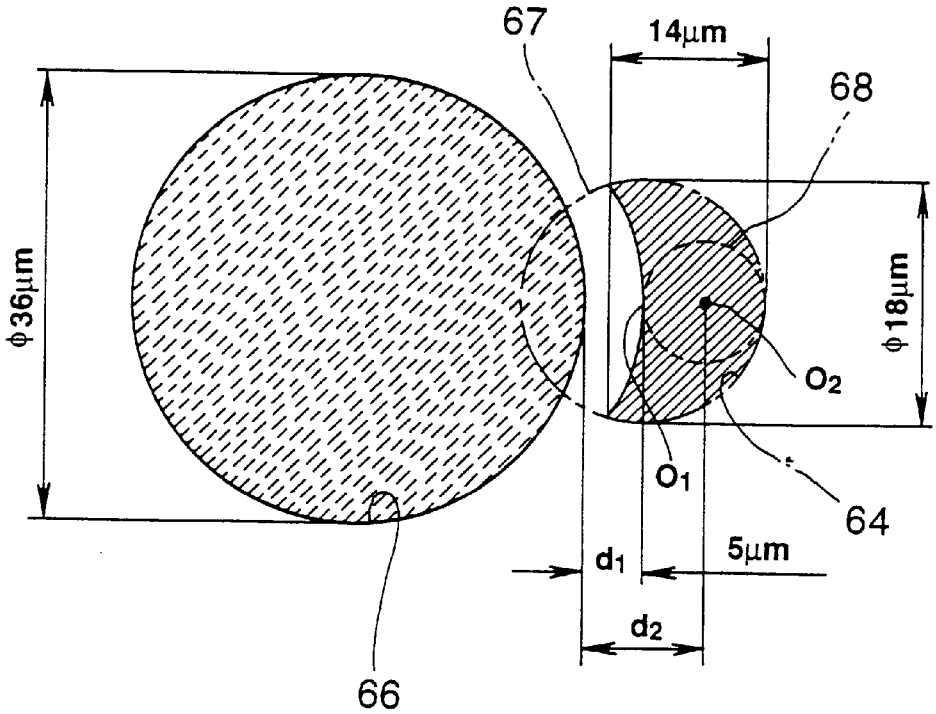
FIG. 8 is a schematic plan view showing essential portions of the vicinity of the emission medium nozzle and the quantitation medium nozzle of a printer head of a typical printer device according to the present invention.

Referring to FIG. 8, the opening of the second nozzle portion 66 of the emission medium nozzle 54 is circular, whereas the opening of the first nozzle portion 64 of the quantitation medium nozzle 53 is of a partially eclipsed shape. That is, in this shape, the minimum distance d2 between the center o2 of an inscribed circle 68 of the opening of the first nozzle portion 64 operating as an aperture of the quantitation medium nozzle 53 and the opening of the emission medium nozzle 54, indicated by a broken line, is larger than the minimum distance d1 between the center o1 of a circumscribed circle 67 of the opening of the first nozzle portion 64 and the opening of the emission medium nozzle 54 as indicated by a chain-dotted line in FIG. 8.

Stated further differently, with the printer device according to the present invention, the opening of the quantitation medium nozzle 53 is shaped such that the opening edge of the quantitation medium nozzle 53 closest to the center of the opening of the quantitation medium nozzle 53 is provided towards the neighboring emission medium nozzle 53 opened at a neighboring position.

Figure 9:
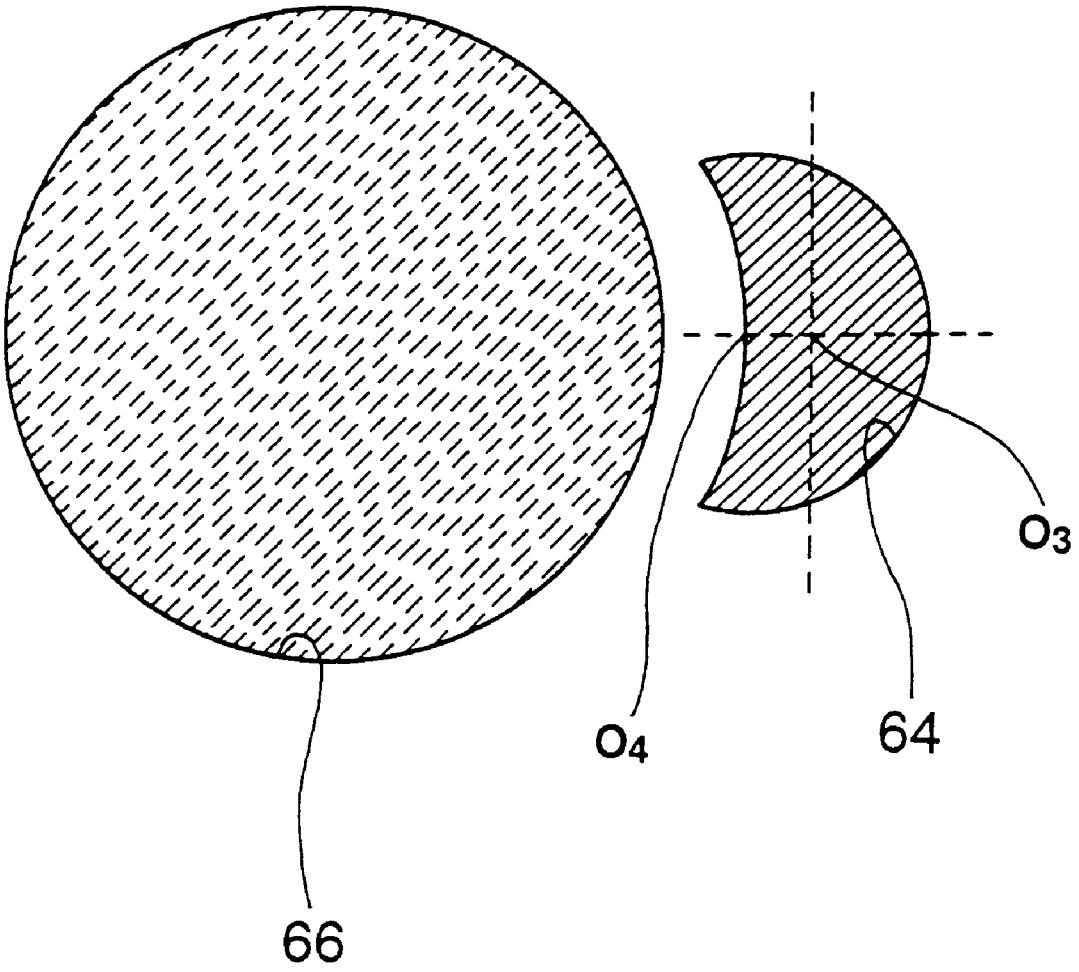
FIG. 9 is a schematic plan view showing essential portions of the vicinity of the emission medium nozzle and the quantitation medium nozzle of a printer head of a typical printer device according to the present invention.

Specifically, the opening of the first nozzle portion 64 of the quantitation medium nozzle 53 is of a partially eclipsed shape such that the opening edge o4 closest to the center o3 of the opening of the first nozzle portion 64 is positioned towards the second nozzle portion 66 operating as the opening of the emission medium nozzle 54, as shown in FIG. 9.

Preferably, the opening is of a partially cut out point-symmetrical shape. The point-symmetrical shape may be a circle or a polygon, with the cut-out being arcuate or angulated, only by way of examples.

Although the opening of the embodying the present invention nozzle 54 is circular in the above examples, it may be rectangular or polygonal.

Although a set of the quantitation medium nozzle 53 and the emission medium nozzle 54 is illustrated, the printer device according to the present invention has 16 such sets, arranged with the quantitation medium nozzles 53 lying adjacent to the emission medium nozzles 54.

In the printer device of the present embodiment, layered piezoelectric devices are used as pressure generating means. However, other pressure generating means, such as so-called single-plate piezoelectric devices, heating devices or magnetostrictive devices, may be used in the printer device according to the present invention.

For effecting printing by the instant embodiment of the printer device, the following processing may be used: In the present embodiment and in the comparative example, the emission period is 1 msec (frequency of 1 kHz) during which occurs quantitative mixing of the quantitation medium and emission of the mixed liquid droplets. The maximum driving voltage of the first layered piezoelectric device 43 is 10 V, whole the maximum driving voltage of the second layered piezoelectric device 44 is 15 V.

For printing, it suffices to repeat the above processing. However, for representing gradation in concentration, it is necessary to vary the ink concentration every dot. In the present embodiment, it suffices to this end to change the amplitude (voltage) of the driving pulse of the first layered piezoelectric device 43 during quantitation from 10 V to, for example, 4 kV and to decrease the amount of the quantitated ink to form dots of low concentration in order to represent the gradation in concentration.

Meanwhile, in the instant embodiment, so-called layered piezoelectric devices are used as the first layered piezoelectric device 43 and the second layered piezoelectric device 44. As the layered piezoelectric device, the device exploiting displacement in the direction of elongation as a result of voltage application (so-called d33 direction) is used in preference to that exploiting displacement in the direction of contraction as a result of voltage application (so-called d31 direction).

Figure 10:
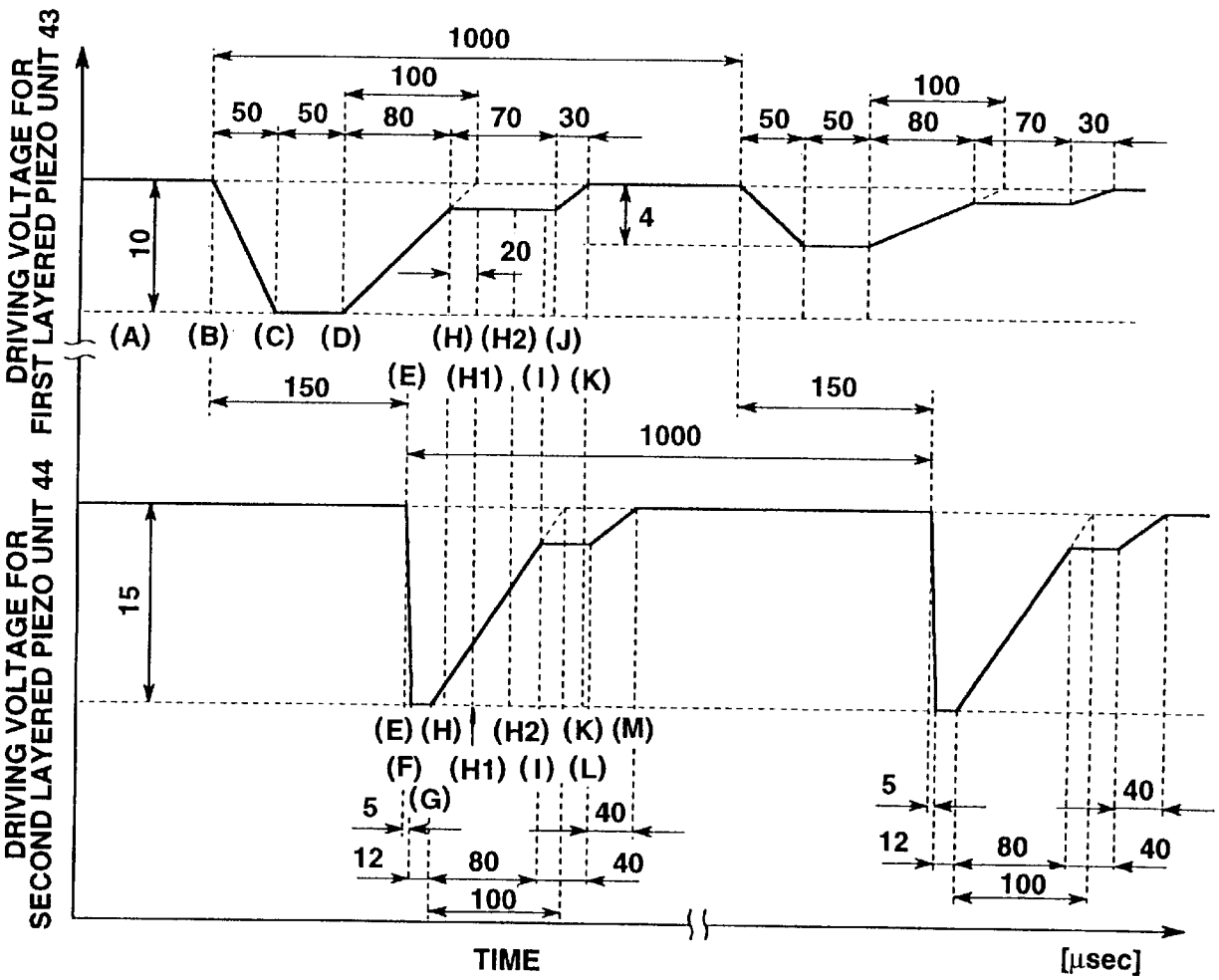
FIG. 10 is a chart for illustrating the timing of application of a driving voltage across pressure control means of a printer device according to the present invention.

Reference is now had to the timing chart of applying the driving voltage shown in FIG. 10. In the timing chart for application of the driving voltage, shown in FIG. 10, the driving voltages for the first layered piezoelectric device 43 and the second layered piezoelectric device 44 are set to 15 V, respectively, both being positive voltages. In FIG. 10, the abscissa and the ordinate denote time and the driving voltages of the first and second layered piezoelectric devices 43, 44, respectively.

Figure 11:
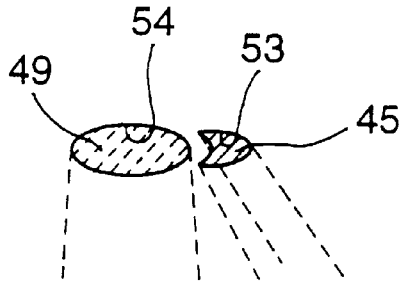
FIG. 11, illustrating the printing operation by a typical printing device according to the present invention in the order of the operational sequence, is a schematic perspective view showing the stand-by state.
Figure 12:
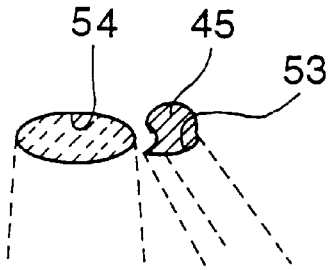
FIG. 12, illustrating the printing operation by a typical printing device according to the present invention in the order of the operational sequence, is a schematic perspective view showing the state of extrusion of the quantitation medium.

At this time, the quantitation medium 45 is charged up to the distal end of the quantitation medium nozzle 53, with an outwardly convex liquid surface (meniscus) being formed, while the emission medium is similarly formed up to the distal end of the emission medium nozzle 54, with a meniscus being similarly formed, as schematically shown in FIG. 11. The operating state is then a stand-by state. It is noted that, at this time point, the driving voltage is applied across the first and second layered piezoelectric devices43, 44 to warp these devices 43, 44, with the portions of the vibration plate contacting with these deformed portions being raised to increase the volume of the quantitation medium pressure chamber 56 and the emission medium pressure chamber 58. In the printer head of the printer device of the present embodiment, since the quantitation medium nozzle 53 is provided independently of the emission medium nozzle 54, there is no risk of the quantitation medium 45 contacting with the emission medium 49, such that natural mixing cannot occur in this stand-by state.

Then, from a time point shown at B in FIG. 10 until a time point shown at C in FIG. 10, which is 50 μsec following the time point B, the driving voltage applied across the first layered piezoelectric device 43 is lowered gradually to 0 V. This deforms the first layered piezoelectric device 43 to thrust the portion of the vibration plate 42 contacted therewith to decrease the volume in the quantitation medium pressure chamber 56. Thus, between the time point shown at B in FIG. 10 and the time point shown at C in FIG. 10, the quantitation medium 45 is extruded from the quantitation medium nozzle 53. Since the quantitation medium nozzle 53 is formed to approach the emission medium nozzle 54 progressively, the quantitation medium 45 is extruded towards the emission medium nozzle 54.

Figure 13:
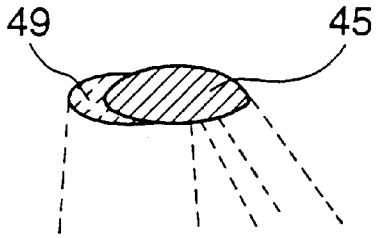
FIG. 13, illustrating the printing operation by a typical printing device according to the present invention in the order of the operational sequence, is a schematic perspective view showing the state in which the quantitation medium and the emission medium are contacted and combined together.

This state is maintained since the time shown at C in FIG. 10 until a time point shown at D in FIG. 10. At this time point shown at D in FIG. 10, the quantitation medium 45 is contacted with the emission medium 49 so as to be combined therewith under surface tension, as shown in FIG. 13.

Then, since the time point shown at D in FIG. 10 until a time point shown at H in FIG. 10, the driving voltage of the first layered piezoelectric device 43 is raised progressively. This again deforms first layered piezoelectric device 43 to increase the volume in the quantitation medium pressure chamber 56 so that the quantitation medium 45 starts to be pulled into the quantitation medium nozzle 53.

Figure 14:
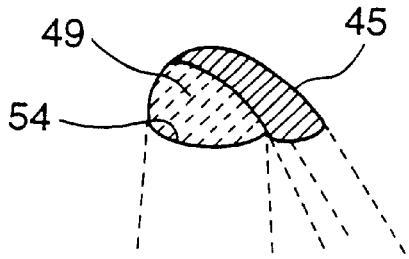
FIG. 14, illustrating the printing operation by a typical printing device according to the present invention in the order of the operational sequence, is a schematic perspective view showing the state in which the quantitation medium and the emission medium start to be extruded.

Then, since a time point shown at E in FIG. 10, which is later than the time point shown at D in FIG. 10, until a time point shown at F in FIG. 10, the driving voltage to the second layered piezoelectric device 44 is lowered from 15 V to 0 V. This deforms the second layered piezoelectric device 44 to thrust the vibration plate 42 in contact therewith to decrease the volume in the emission medium pressure chamber 58. Thus, at the time point shown at F in FIG. 10, the emission medium 49 starts to be extruded from the emission medium nozzle 54, as schematically shown in FIG. 14, such that part of the quantitation medium in contact therewith starts to be extruded simultaneously.

Figure 15:
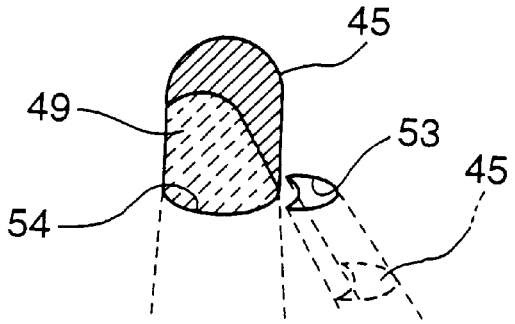
FIG. 15, illustrating the printing operation by a typical printing device according to the present invention in the order of the operational sequence, is a schematic perspective view showing the state in which the quantitation medium and the emission medium are being extruded further.

Since the time point shown at F in FIG. 10 until a time point shown at G in FIG. 10, which is 12 μsec after the time point F, the driving voltage to the second layered piezoelectric device 44 is kept. During this time, the emission medium 49 is further extruded from the emission medium nozzle 54 along with the quantitation medium 45, as shown in FIG. 15.

Since the driving voltage of the first layered piezoelectric device 43 keeps on to be increased, the quantitation medium 45 is pulled into the quantitation medium nozzle 53, while the portion of the quantitation medium 45 contacted with the emission medium 49 is left over.

Then, since the time point shown at G in FIG. 10 until a time point shown at I in FIG. 10, which is 80 μsec after the time point G, the driving voltage to the second layered piezoelectric device 44 is increased progressively. This again starts to deform the second layered piezoelectric device 44 to increase the volume of the emission medium pressure chamber 58.

Figure 16:
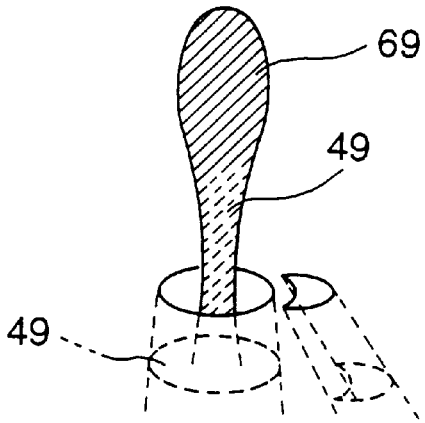
FIG. 16, illustrating the printing operation by a typical printing device according to the present invention in the order of the operational sequence, is a schematic perspective view showing the state in which constrictions start to be produced between the mixed solution and the emission medium.
Figure 17:
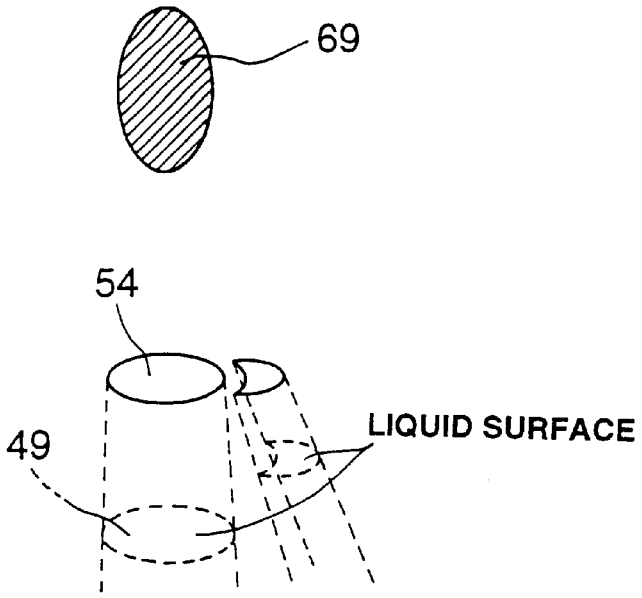
FIG. 17, illustrating the printing operation by a typical printing device according to the present invention in the order of the operational sequence, is a schematic perspective view showing the state in which the mixed solution is being emitted.

Since the time point shown at H in FIG. 10, which is later by 80 μsec after the time point D in FIG. 10, the driving voltage to the first layered piezoelectric device 43 is kept at a pre-set constant voltage not higher than 10 V. At a time point H1 in FIG. 10, later by approximately 20 μsec since the time point H in FIG. 10, a constriction starts to be produced between the mixed solution and the emission medium 49, as shown in FIG. 16.

During the time shown at H2 in FIG. 10 since the time point shown at H1 in FIG. 10 until a time point I in FIG. 10 which is later 70 μsec since time H in FIG. 10, the mixed solution is completely emitted from the emission medium nozzle 54.

Since the time point shown at I in FIG. 10 until a time point L in FIG. 10 which is later 40 μsec from the time point I, the driving voltage of the second layered piezoelectric device 44 is kept at a pre-set constant value not larger than 15 V.

Since a time point J in FIG. 10, slightly later than the time point I, until a time point K in FIG. 10 later 30 μsec than the time point J, the driving voltage applied to the pressure control means on the quantitation medium side (first layered piezoelectric device 43) is varied to reduce the gradient of the driving voltage to a value smaller than the gradient of the driving voltage during the time points D and H in FIG. 10 to raise the driving voltage of the first layered piezoelectric device 43 to 10 V.

Figure 18:
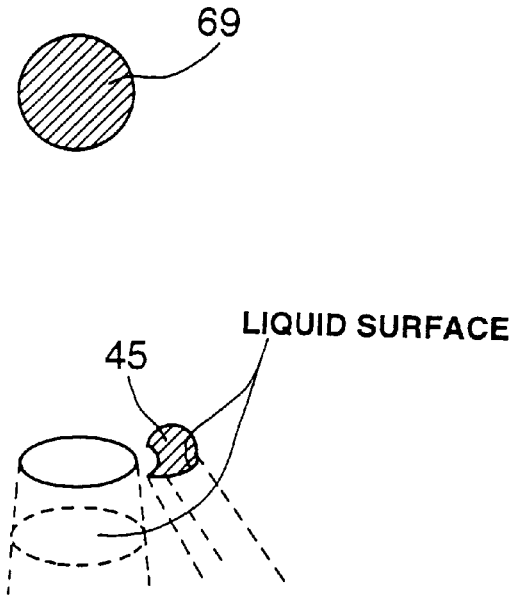
FIG. 18, illustrating the printing operation by a typical printing device according to the present invention in the order of the operational sequence, is a schematic perspective view showing the state in which the mixed solution continues its flight and re-charging of the quantitation medium into the nozzle comes to a close, with the liquid surface of the quantitation medium being in stability.

By varying the driving voltage applied to the pressure control means on the quantitation medium side for reducing its gradient, there is applied a pressure in a direction of pulling the liquid surface of the quantitation medium 45 towards the inside of the quantitation medium nozzle 53 during the time until reversion of the liquid surface of the quantitation medium 45 to the opening end of the quantitation medium nozzle 53. The result is that the quantitation medium 45 is progressively charged by the capillary tension into the inside of the quantitation medium nozzle 53, as shown in FIG. 18, at the same time as the liquid surface is stably located at the opening end of the quantitation medium nozzle 53 without becoming convexed to outside from the opening end of the quantitation medium nozzle 53.

Also, at this time point, the mixed liquid 69 continues its flight in a ball shape towards the recording support, not shown, so as to be then deposited on the recording support for effecting the recording.

Since a time point K in FIG. 10, the driving voltage of the first piezoelectric device 43 is restored to and kept at 10 V.

Since the time point L until tie point M in FIG. 10, later 40 μsec since the time point L, the driving voltage applied across the pressure control means on the emission medium side (second layered piezoelectric device 44) is varied so that its gradient will be smaller than the gradient of the driving voltage of the second layered piezoelectric device 44 during the time points G and I in FIG. 10, with the driving voltage applied across the second layered piezoelectric device 44 being increased to 15 V.

Figure 19:
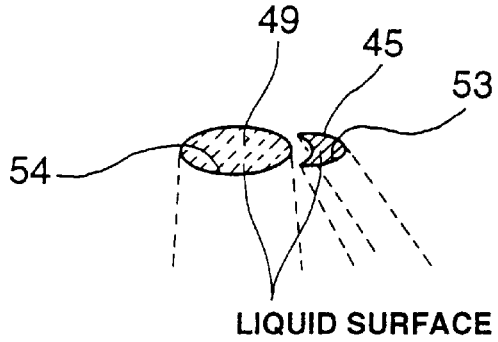
FIG. 19, illustrating the printing operation by a typical printing device according to the present invention in the order of the operational sequence, is a schematic perspective view showing the state in which re-charging of the emission medium into the nozzle comes to a close, with the liquid surface of the emission medium being in stability and with the liquid surfaces of the quantitation medium and the emission medium both reverting to the stand-by state.

By varying the driving voltage applied across the pressure control means on the emission medium side for reducing its gradient, there is applied a pressure in a direction of pulling the liquid surface of the emission medium 49 towards the inside of the emission medium nozzle 54 during the time until reversion of the liquid surface of the quantitation medium 45 to the opening end of the emission medium nozzle 54. The result is that the emission medium 49 is progressively charged by the capillary tension into the inside of the emission medium nozzle 54, as shown in FIG. 19, at the same time as the liquid surface is stably located at the opening end of the quantitation medium nozzle 53 without becoming convexed to outside from the opening end of the quantitation medium nozzle 53.

Since a time point M in FIG. 10, the driving voltage of the second layered piezoelectric device 44 is restored to and kept at 15 V. At this time, the liquid surfaces of the quantitation medium 45 and the emission medium 49 are at the stand-by state, as in FIG. 11, at the opening ends of the quantitation medium nozzle 53 and the emission medium nozzle 54, respectively.

Thus, in the present embodiment, the rise of the driving voltage of the first and second layered piezoelectric devices 43, 44 is divided into two stages, as shown in FIG. 10, and the second rising of the driving voltage of the first and second layered piezoelectric devices 43, 44 is synchronized with the timing of reversion of the liquid surfaces of the quantitation medium 45 and the emission medium 49 to the nozzle opening end for generating the pressure operating in a direction of pulling the quantitation medium 45 and the emission medium 49 into associated nozzles. This applies a moderate braking to the speeds with which the quantitation medium 45 and the emission medium 49 are restored to the distal ends of the associated nozzles to prevent leakage of the quantitation medium 45 and the emission medium 49 at the nozzle opening ends.

In the above-described printer device, operating on the basis of the timing chart of application of the driving voltage, according to the present invention, the quantitation medium 45 is pressurized in a direction of pulling the liquid surface of the quantitation medium 45 towards the inside of the quantitation medium nozzle 53, during the time which elapses since the emission of the quantitation medium 45 at the quantitation medium nozzle 53 until reversion of the liquid surface of the quantitation medium 45 to the opening end of the quantitation medium nozzle 53, in order to prevent the quantitation medium 45 from overflowing the quantitation medium nozzle 53 to flow into the emission medium nozzle 54 due to reaction to the operation of quantitation.

Also, in the above-described printer device, operating on the basis of the timing chart of application of the driving voltage, according to the present invention, the emission medium 49 is pressurized in a direction of pulling the liquid surface of the emission medium 49 towards the inside of the emission medium nozzle 54, during the time which elapses since the emission of the emission medium 49 at the emission medium nozzle 54 until reversion of the liquid surface of the emission medium 49 to the opening end of the emission medium nozzle 54, in order to prevent the emission medium 49 from overflowing the emission medium nozzle 54 to flow into the quantitation medium nozzle 53.

This evades unneeded mixing of the quantitation medium 45 and the emission medium 49 after mixing and emission to render it possible to mix correct amounts of the quantitation medium 45 and the emission medium 49 in keeping with the gradation to realize correct gradation representation.

Also, the printer device according to the present invention includes pressure control means driven on voltage application to control the pressure applied to the quantitation medium 45. The voltage applied to the pressure control means is varied so that the quantitation medium 45 is pressurized in a direction of puling the liquid surface of the quantitation medium 45 into the inside of the quantitation medium nozzle 53 after emission of the quantitation medium 45.

In addition, the printer device according to the present invention includes pressure control means driven on voltage application to control the pressure applied to the emission medium 49. The voltage applied to the pressure control means is varied so that the emission medium 49 is pressurized in a direction of puling the liquid surface of the emission medium 49 into the inside of the emission medium nozzle 54 after emission of the emission medium 49.

By varying the voltage applied to the pressure control means, it becomes possible to avoid unneeded mixing of the quantitation medium 45 and the emission medium 49 after emission.

In the present embodiment, the driving voltage of the quantitation medium 45 and the emission medium 49 to control the pressure in the quantitation medium pressure chamber 56 and in the emission medium pressure chamber 58 for more efficiently evading unneeded mixing of the quantitation medium 45 and the emission medium 49. However, it is also possible to vary only the voltage applied to pressure control means for one of the mediums which manifests significant mixing.

Also, in the present embodiment, the second rising of the driving voltage of the first and second layered piezoelectric devices 43, 44 as pressure control means is synchronized with the timings of reversion to the nozzle opening ends of the liquid surfaces of the quantitation medium 45 and the emission medium 49, respectively, for generating the pressure in a direction of pulling the quantitation medium 45 and the emission medium 49 into the nozzles.

As for the driving voltage and the accompanying driving waveform, it is not indispensable to have the rising of the driving voltage completely synchronized with the timings of reversion to the nozzle opening ends of the liquid surfaces of the quantitation medium 45 and the emission medium 49. Specifically, the driving waveform may be designed so that, by adjusting the gradient of the rising, timing, waveform shape or the number of times in the course of increasing the driving voltage for reversion to the original voltage, as shown in FIGS. 21 to 24, a moderate pressure is generated in the direction of pulling the quantitation medium 45 and the emission medium 49 into the nozzles to prevent the liquid surfaces of the mediums from overflowing to stop the liquid surfaces at the distal ends of the nozzles.

Figure 20:
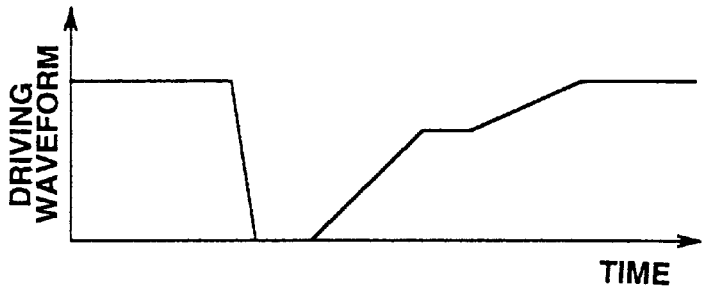
FIG. 20 is a chart showing a typical driving waveform of pressure control means of a printer device according to the present invention.
Figure 21:
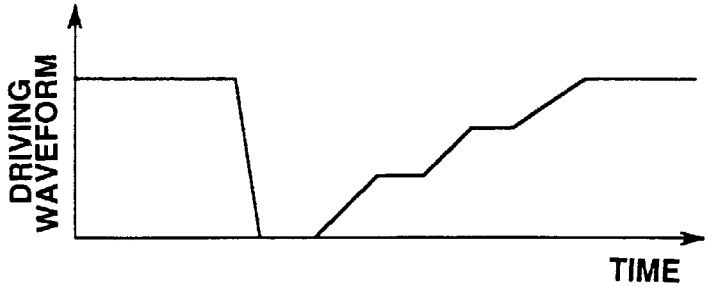
FIG. 21 is a chart showing another typical driving waveform of pressure control means of a printer device according to the present invention.

The driving waveform shown in FIG. 20 corresponds to the above-described embodiment. Thus, the rising of the driving waveform can be divided in three stages, as shown in FIG. 21, that is, two rising-stop stages of the driving voltage can be provided instead of one so that the driving voltage will be increased in three stages.

Figure 22:
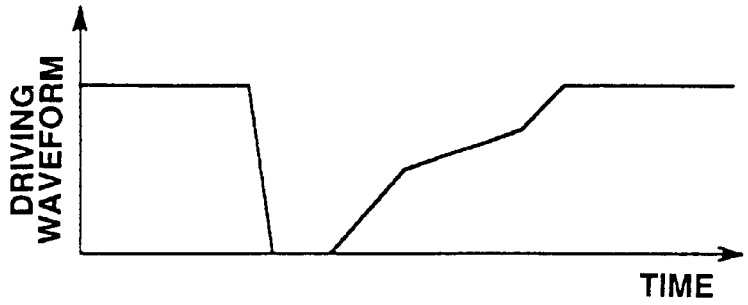
FIG. 22 is a chart showing a further typical driving waveform of pressure control means of a printer device according to the present invention.

Also, the gradient of the rising of the driving voltage can be changed, that is, the rising of the driving voltage is not stopped but only the gradient is decreased twice on end for reversion to the original voltage, as shown in FIG. 22. Specifically, during reversion of the driving voltage to the original voltage, the gradient can be decreased a plural number of times without providing stop stages.

Figure 23:
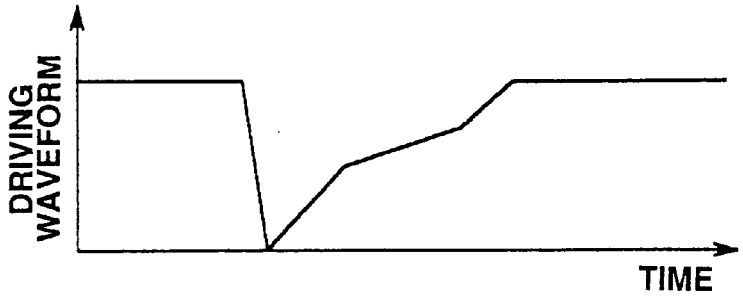
FIG. 23 is a chart showing a still further typical driving waveform of pressure control means of a printer device according to the present invention.

In addition, the flat portions of the driving waveform may be eliminated, that is the driving voltage holding stage following medium emission may be eliminated, as shown in FIG. 23.

Figure 24:
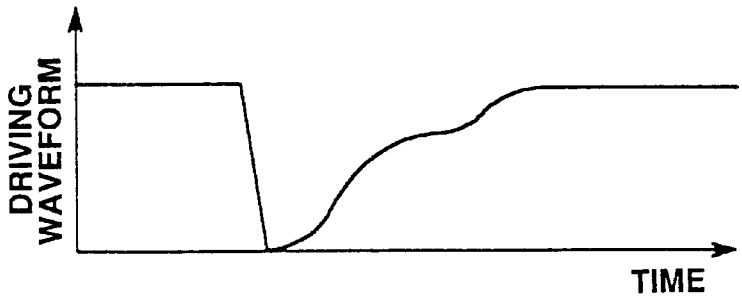
FIG. 24 is a chart showing yet another typical driving waveform of pressure control means of a printer device according to the present invention.

Further, the rising of the driving waveform may be curved, that is the driving voltage may be adjusted so that the driving waveform of the driving voltage will present an optional curve to control leakage of the medium liquid surface from the nozzles, as shown in FIG. 24.

Figure 25:
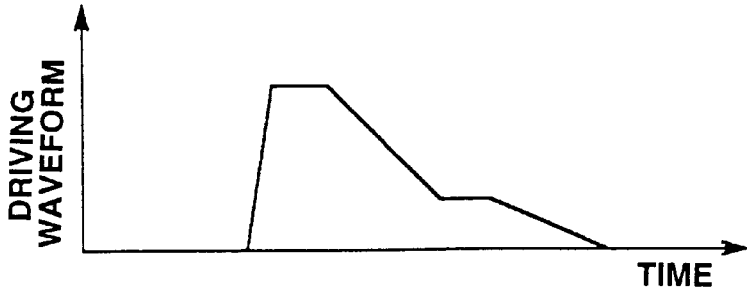
FIG. 25 is a chart showing an example of a driving waveform reversed in polarity to realize the driving waveform shown in FIG. 20.
Figure 26:
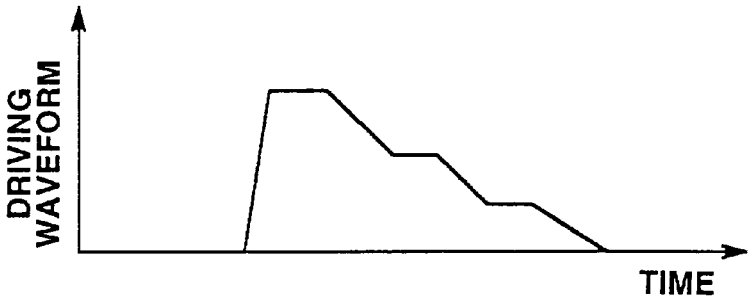
FIG. 26 is a chart showing an example of a driving waveform reversed in polarity to realize the driving waveform shown in FIG. 21.
Figure 27:
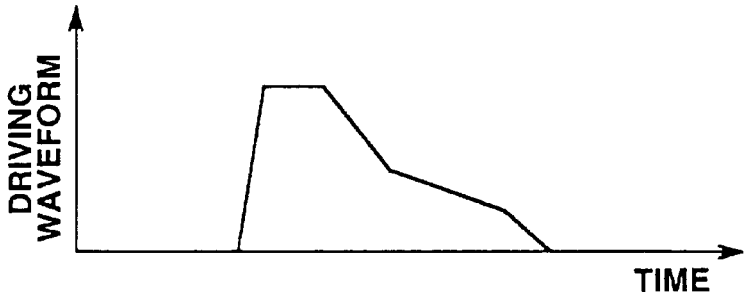
FIG. 27 is a chart showing an example of a driving waveform reversed in polarity to realize the driving waveform shown in FIG. 22.
Figure 28:
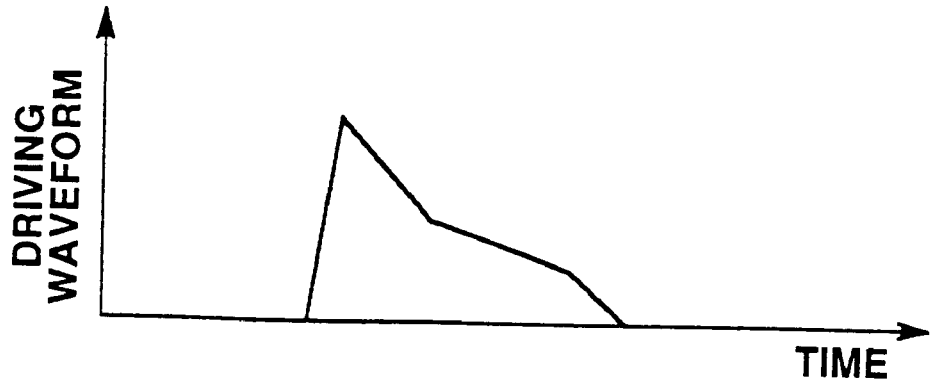
FIG. 28 is a chart showing an example of a driving waveform reversed in polarity to realize the driving waveform shown in FIG. 23.
Figure 29:
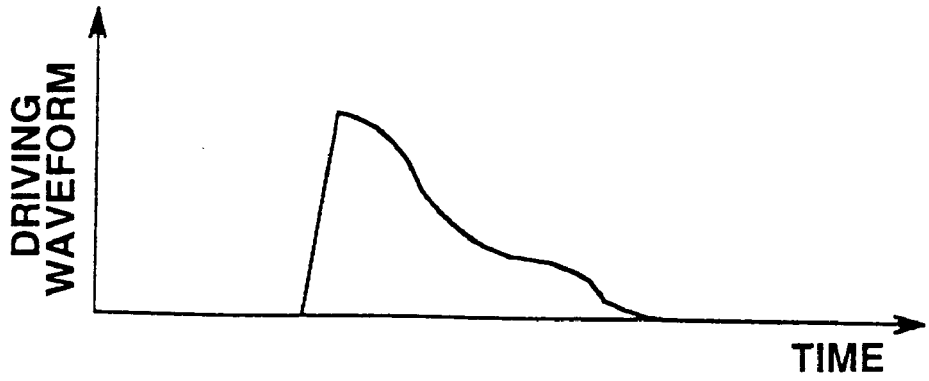
FIG. 29 is a chart showing an example of a driving waveform reversed in polarity to realize the driving waveform shown in FIG. 24.

FIG. 25 shows the driving waveform when the displacement in the d33 direction is used. If the displacement in the d33 direction is used, the positive- or negative-going changes of the driving waveform may be reversed, as shown in FIGS. 25 to 29, for effecting the driving as shown in FIGS. 20 to 24.

Figure 30:
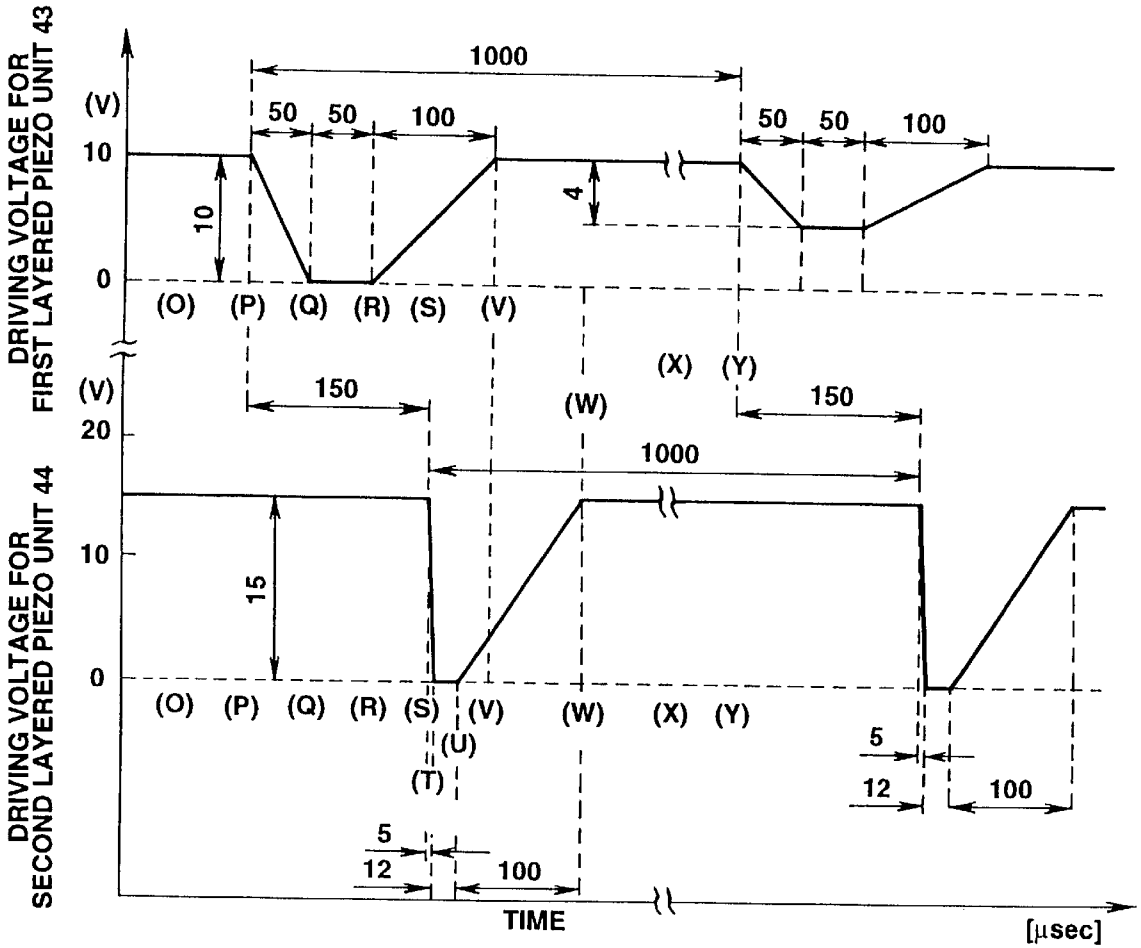
FIG. 30 is a chart showing the timing of application of a driving voltage to the pressure control means of a printer device of a comparative embodiment.

As a comparative embodiment of the printer device of the present invention, a printer device operating in accordance with the timing chart for application of the driving voltage as shown in FIG. 30 was used.

The timing chart for application of the driving voltage in the present comparative embodiment is such that, during a time interval between time points R and V in FIG. 30, corresponding to the time interval during which, after emission of the quantitation medium 45, its liquid surface reverts to the opening end of the quantitation medium nozzle 53, the gradient of the first layered piezoelectric device 43 is rendered constant before reversion to the original 10 V.

Also, the timing chart for application of the driving voltage is such that, during a time interval between time points U and V in FIG. 30, corresponding to the time interval during which, after emission of the emission medium 49, its liquid surface reverts to the opening end of the emission nozzle, the gradient of the second layered piezoelectric device 44 is rendered constant before reversion to the original 15 V.

The driving voltage of the first layered piezoelectric device 43 during the intervals between time points O and R and between time points V and X in FIG. 30 and that of the second layered piezoelectric device 44 during the interval between time points O and U and since time point W in FIG. 30 were applied in the same way as in the embodiment of FIG. 10.

Figure 31:
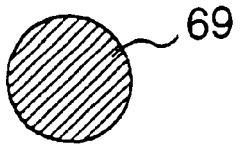
FIG. 31, illustrating part of the printing operation by a printing device of the comparative embodiment in the order of the operational sequence, is a schematic perspective view showing the state in which the mixed solution continues its flight and the liquid surface of the quantitation medium is swollen outward from the opening end of the quantitation medium nozzle.
Figure 31:
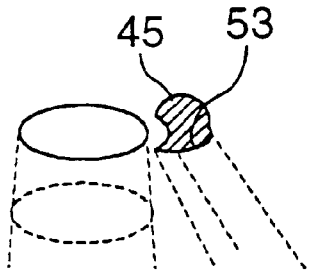

In particular, between the time points V and W in FIG. 30, the quantitation medium 45 is progressively charged into the quantitation medium nozzle 53 under the capillary tension, such that, at time point W in FIG. 30, the quantitation medium 45 is charged up to the distal end of the quantitation medium nozzle 53, as shown schematically in FIG. 31. However, at a time point W in FIG. 30, the distal end of the quantitation medium 45 is slightly vibrated to form a swollen portion, as shown schematically in FIG. 31.

Figure 32:
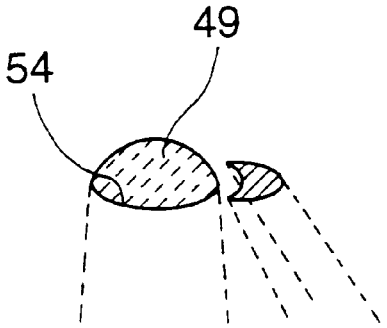
FIG. 32, illustrating part of the printing operation by a printing device of the comparative embodiment in the order of the operational sequence, is a schematic perspective view showing the state in which the liquid surface of the emission medium is swollen outward from the opening end of the emission medium nozzle.
Figure 33:
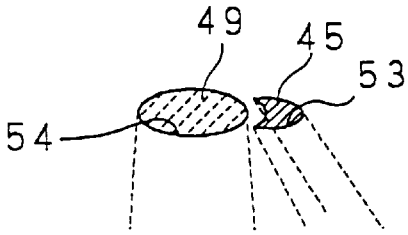
FIG. 33, illustrating part of the printing operation by a printing device of the comparative embodiment in the order of the operational sequence, is a schematic perspective view showing the state in which the liquid surfaces of the quantitation medium and the emission medium are both stabilized and restored to the stand-by state.

At a time point shown at X in FIG. 30, later than the time point shown at W in FIG. 30, the emission medium 49 is charged into the emission medium nozzle 54 under the capillary tension, as is the quantitation medium 45. The distal end of the emission medium 49 is slightly vibrated to form a swollen portion, as shown schematically in FIG. 32.

At a time point shown at Y in FIG. 30, later than the time point X and later 1000 $\mu$sec than the time pint P in FIG. 30, the emission medium 49 ceases to be vibrated to revert to the stand-by state.

During this sequence of operations, the quantitation medium 45 or the emission medium 49 during the re-charging operation occasionally flow into the emission medium nozzle 54 or into the quantitation medium nozzle 53 under the vigour of the swelling of the mediums.

Figure 34:
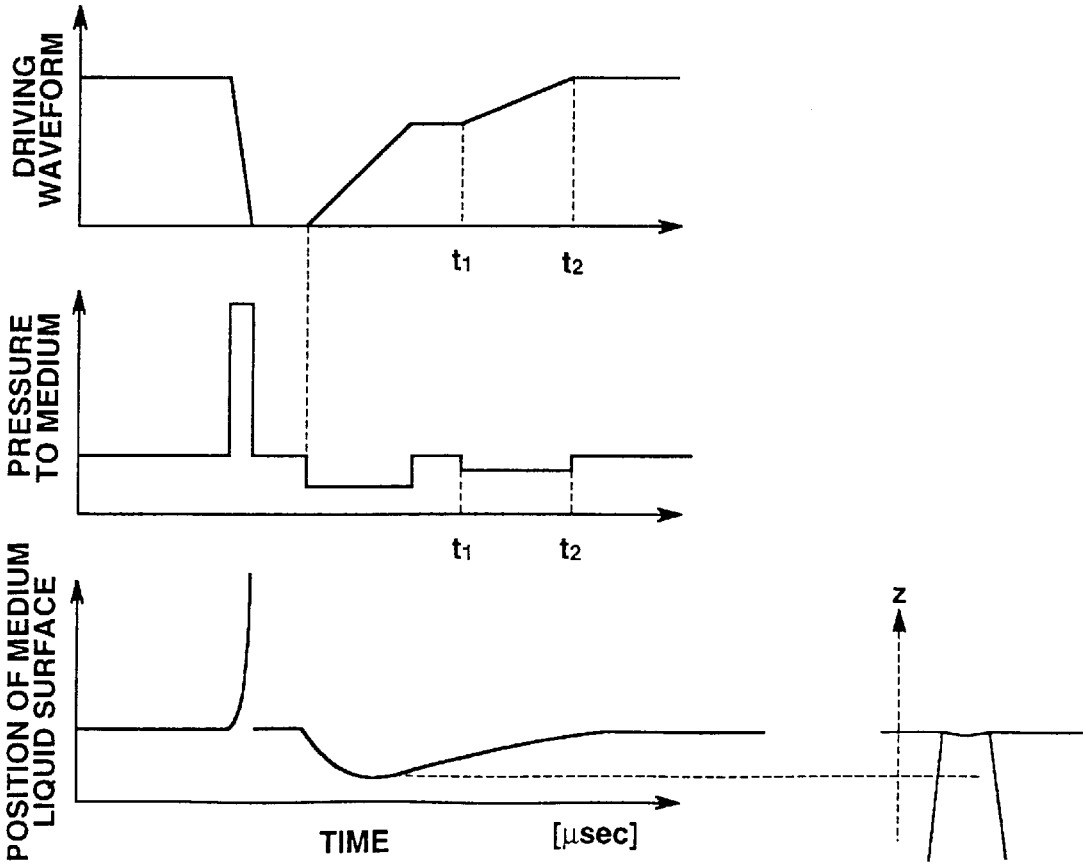
FIG. 34 is a chart showing the driving waveform applied to the pressure control means of the present embodiment, pressure applied to the medium and the position of the liquid surface of the medium.
Figure 35:
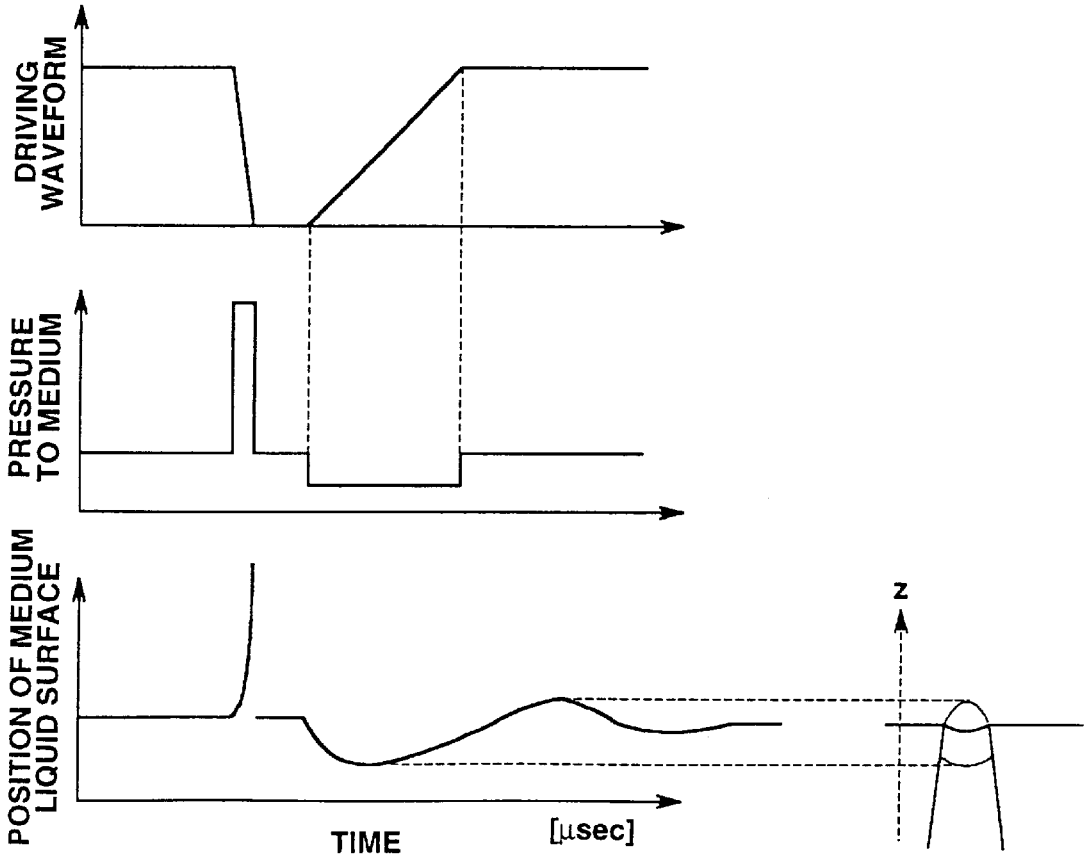
FIG. 35 is a chart showing the driving waveform applied to the pressure control means of the comparative embodiment, pressure applied to the medium and the position of the liquid surface of the medium.

In connection with the above-described present embodiment and the comparative embodiment, FIGS. 34 and 35 schematically illustrate the driving waveform, the pressure applied to the medium pressure chambers and the positions of the medium liquid surfaces. In FIGS. 34 and 35, which are only schematic illustrative views, the abscissa denotes time and the ordinate denotes the driving waveform, the pressure applied to the medium pressure chambers and the positions of the medium liquid surfaces. The mediums herein arbitrarily mean the quantitation medium 45 or the emission medium 49.

Referring to FIG. 34, the gradient of the driving waveform corresponding to the driving voltage is varied during the time interval t1 to t2 during which the medium liquid surface reverts to the nozzle opening end, such that the pressure applied to the medium pressuring chamber is generated in the direction of pulling the liquid surface into the inside of the nozzle. Thus it is seen that, if the liquid surface reverts to the nozzle opening end, the liquid is not swollen outward to evade unneeded mixing of the quantitation medium 45 and the emission medium 49 following emission to realize mixing of correct amounts of the mediums 45, 49 in keeping with the gradation to realize representation of correct gradation.

On the other hand, in the comparative embodiment shown in FIG. 35, the gradation of the driving waveform corresponding to the driving voltage is kept constant during the time which elapses since emission of the medium until reversion of the liquid surface to the nozzle opening end, such that the liquid surface is swollen outward to form a meniscus at the time of restoration of the liquid surface to the nozzle opening end. Thus, there is raised a problem that the quantitation medium 45 tends to flow from the quantitation medium nozzle into the emission medium or that the emission medium 49 tends to flow from the emission medium nozzle into the quantitation medium.

Figure 36:
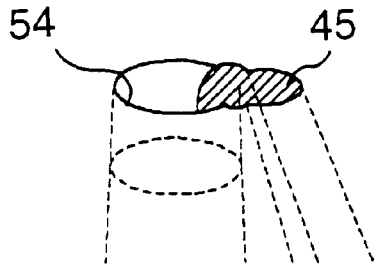
FIG. 36 is a schematic perspective view for illustrating a problem inherent in the printer device of the comparative embodiment.
Figure 37:
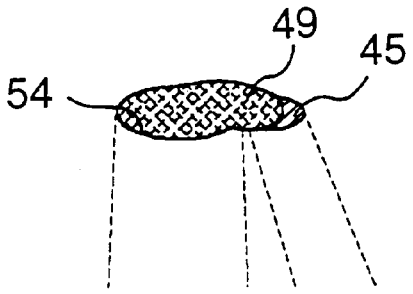
FIG. 37 is a schematic perspective view for illustrating another problem inherent in the printer device of the comparative embodiment.
Figure 38:
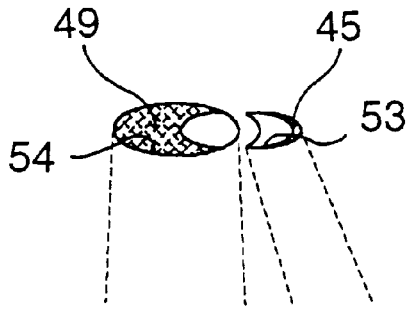
FIG. 38 is a schematic perspective view for illustrating still another problem inherent in the printer device of the comparative embodiment.

Thus, there is raised a problem that the quantitation medium 45 flows into the emission medium nozzle 54, as shown in FIG. 36, the emission medium 49 flows into the quantitation medium nozzle 53, as shown in FIG. 37 or that the quantitation medium 45 and the emission medium 49 flow into the opposite side nozzles, as shown in FIG. 38.

The ink used in the present embodiment and in the comparative embodiment may be enumerated by the following compositions:

| | |
|---|---|
| (Composition) | |
| C.I. Acid Blue 9 | 8 wt % |
| N-methyl-2-pyrrolidone | 10 wt % |
| Ethylene Glycol Monoethyl Ether | 10 wt % |
| Surfactant | 0.01 wt % |
| Water | 71.99 wt % |
| (Physical Values) | |
| viscosity | 2 cp |
| surface tension at 20° C. | 30 dyne/cm |
| (Composition) | |
| Isopropyl Alcohol | 7 wt % |
| Diethylene Glycol | 23 wt % |
| Water | 70 wt % |
| (Physical Values) | |
| viscosity | 2.2 cp |
| surface tension at 20 ° C. | 40 dyne/cm |

Although a dye of a cyan color shown, other colors can, of course, be used. The recording support may be an ordinary paper sheet or a commercial ink jet printing paper sheet.

The openings of the quantitation medium nozzle 53 and the emission medium nozzle 54 of the print head need to be sized in meeting with the volume of the quantitation medium to be quantitated and that of the mixed liquid to be emitted. For example, the opening of the second nozzle portion 66 serving as the opening of the emission medium nozzle 54 is circular with a diameter of 36 μm, while the opening of the first nozzle 64 serving as the opening of the quantitation medium nozzle 53 is of a partially eclipsed circle, obtained on cutting the side towards the second nozzle portion 66 of a circle with a diameter of 18 μm to a depth from the cut-out edge to the bottom of 14 μm and to a distance from the opening edge of the second nozzle portion 66 to the apex of the cut-out of 5 μm. The distance between the quantitation medium nozzle 53 and the emission medium nozzle 54 is not more than 20 μm, preferably not more than 10 μm and more preferably not more than 5 μm.

If this distance is excessive, the driving voltage of the first layered piezoelectric device 43 needs to be increased in order for the quantitation medium 45 to reach the emission medium nozzle 54. However, if this voltage is excessive, the quantitation medium 45 is not extruded towards the emission medium nozzle 54, but is emitted via the quantitation medium nozzle 53 thus leading to unsuccessful mixing of the emission medium with the quantitation medium 45.

The quantitation medium pressure chamber 56 or the emission medium pressure chamber 58 may be of an oblong shape with a width of 0.4 mm, a length of 0.9 mm and a depth of 0.1 mm. The vibration plate 42 may be of a total thickness of 60 μm with a portion thereof formed with the recesses 59, 60 being of a thickness approximately 6 μm.

The above-described printer device of the present embodiment uses a layered piezoelectric device as pressure generating means. However, other types of the pressure generating means, such as single-plate piezoelectric devices, heating elements or magnetostrictive devices, may be used in the printer device according to the present invention. Other types of the pressure generating means may be used on the quantitation and emission sides.

The printer device according to the present invention may be modified without departing from the scope of the invention. For example, various combinations of the above-described embodiments may be employed.

Although the example of the serial type printer devices has been explained, the present invention may also be applied to other types of the printer devices, such as line or drum rotation type printer devices.

Figure 39:
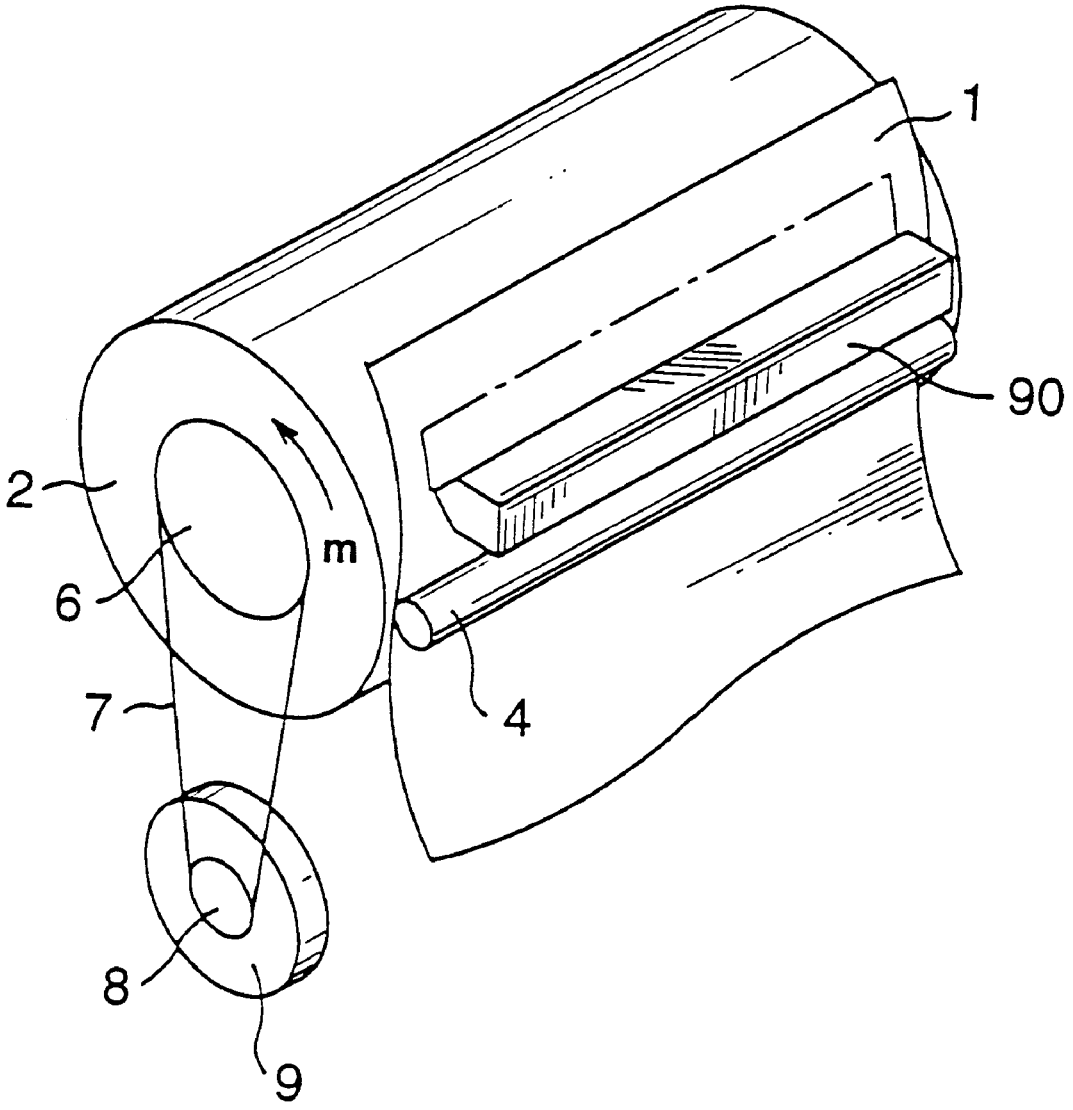
FIG. 39 is a schematic perspective view showing an example of a liquid ejection recording device on which is loaded a printer device according to the present invention.

The above-described line-type printer device is configured as shown in FIG. 39, in which parts or components corresponding to those of the serial type printer device shown in FIG. 1 are denoted by the same reference numerals and the description thereof as well as that of the corresponding control system are omitted for simplicity.

The line type printer device has a line head 90 which carries a large number of printer heads, not shown, arrayed in a line and which is secured in the axial direction of the drum 2. In this line printer device, the line head 90 is adapted to carry out letter printing for one row simultaneously. On completion of letter printing for one row, the drum 2 is rotated for one row as indicated by arrow m to carry out letter printing for the next row. In this case, all lines may be printed collectively or divided in plural blocks or every other row may be printed.

Figure 40:
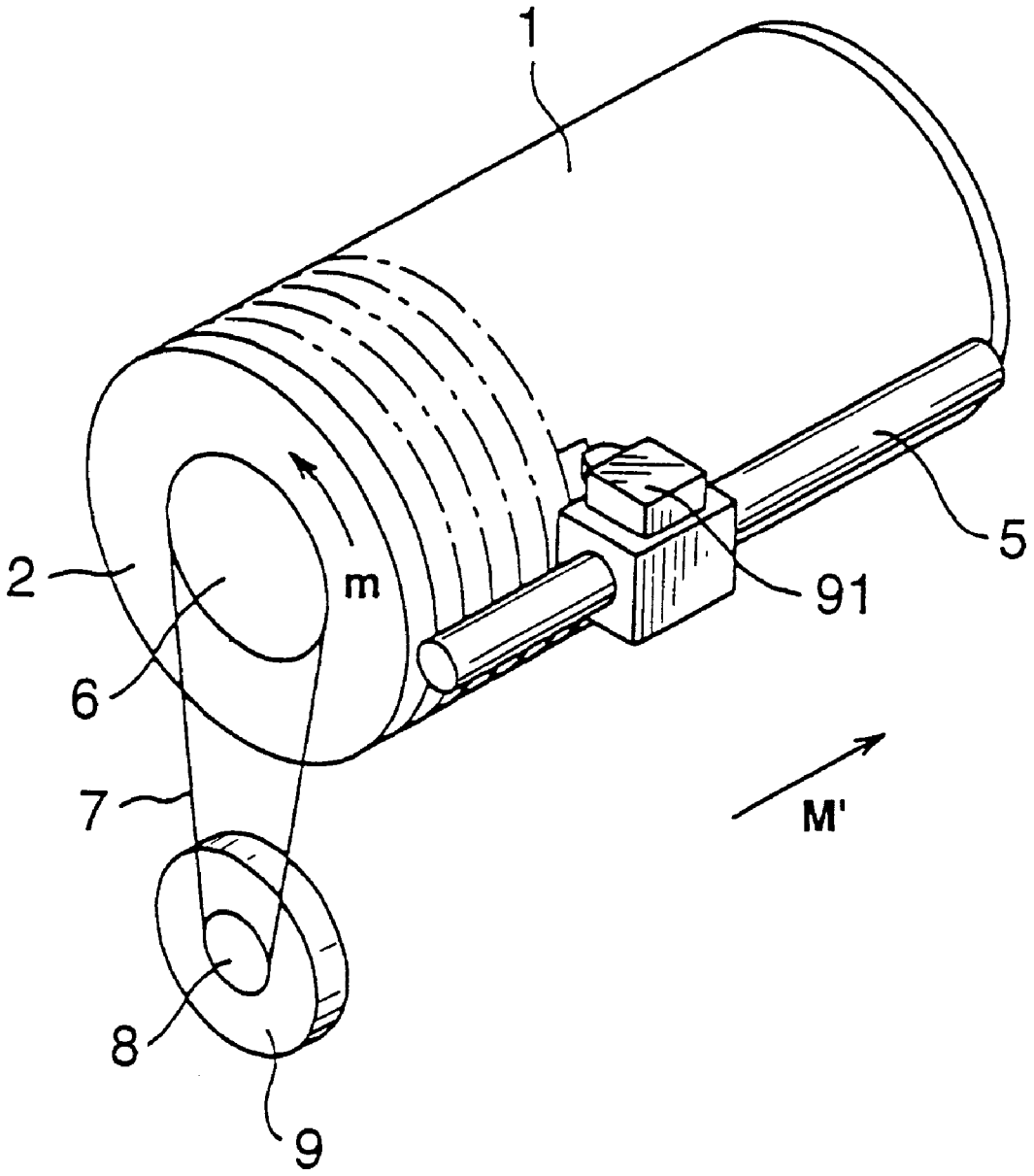
FIG. 40 is a schematic perspective view showing another example of a liquid ejection recording device on which is loaded a printer device according to the present invention.

The drum rotating type printer device is configured as shown in FIG. 40, in which parts or components corresponding to those of the serial type printer device shown in FIG. 1 are denoted by the same reference numerals and the description thereof as well as that of the corresponding control system are omitted for simplicity. In the present printer device, if the drum 2 is run in rotation, the ink is emitted in synchronism with the drum rotation to form an image on the printing paper sheet 1. When the drum 2 completes one revolution in the direction indicated by arrow m to complete letter printing of one row along the circumferential direction, the feed screw 5 is rotated to shift the printer head 91 by one pitch in the direction indicated by arrow magneto-optical disc to effect printing of the next row. In this case, the drum 2 and the feed screw 5 may be rotated simultaneously to shift the printer head 91 gradually simultaneously with printing. In the case of a multi-nozzle head or when repeatedly printing the same portion, the drum 2 and the feed screw 5 are rotated in unison simultaneously to effect spiral printing.

As the quantitation medium 45 according to the present invention, the ink was used, as described above. The dye used for the ink was a water-soluble dye, examples of which are a water-soluble anionic dye (water-soluble direct dye and a water-soluble acidic paint) and a water-soluble cationic dye.

The water-soluble anionic dye may be enumerated by such a dye containing a mono-azo group, dis-azo group, anthraquinone skeleton or a triphenyl methane skeleton as chromophore and also containing anionic water-soluble groups, such as 1–3 sulfonic or carboxylic groups in the molecule.

The water-soluble direct dye for the water-soluble direct dyes may be enumerated by, for example, C.I. Direct Yellow-1 or -8, C.I. Direct Red 1 or 2, C.I. Direct Blue-1, or -2, and C.I. Direct Black 17 or 19, as the yellow direct dye, magenta direct dye, cyan direct dye and black direct dye, respectively.

The water-soluble acidic dye for the water-soluble direct dyes may be enumerated by, for example, C.I. Acid Yellow-1 or -3, C.I. Acid Red 1 or 2, C.I. Acid Blue-1, or -7, and C.I. Acid Black 1 or 2, as the yellow acidic dye, magenta acidic dye, cyan acidic dye and black acidic dye, respectively.

As the water-soluble cationic dye, the azo-dye, triphenyl methane dye, azine dye, oxazine dye or thiazine dye, having amine salts or quaternary ammonium salts, may be used. For example, the yellow dyes and magenta dye, may be enumerated by the C.I. Basic Yellow-1 or -2 and C.I. Basic Red 1 or 2 or C.I. Basic Violet 7 or 10, respectively. The cyan dye and the black dye may be enumerated by C.I. Basic Blue-1 or 3 and C.I. Basic Black 2 and 8, respectively. Most preferred are C.I. Basic Yellow 21, 36, 67 and 73.

The dilution liquid used as the emission medium 49 embodying the present invention may be the water-soluble organic solvent mixed with water. The water-soluble organic solvent may be enumerated by aliphatic monovalent alcohols, polyhydric alcohols and derivatives thereof.

Examples of the aliphatic monovalent alcohols include lower alcohols, such as methyl alcohol, ethyl alcohol or propyl alcohol, of which ethyl alcohol and i-propyl alcohol are preferred. This monohydric alcohol may be used for adjustment of the surface tension for improving penetration into recording mediums, such as ordinary paper sheet or dedicated paper sheet, for forming properties and drying properties of the printed images.

Examples of polyhydric alcohols include alkylene glycols, such as ethylene glycol, propylene glycol or glycerol, and polyalkylene glycols, such as polyethylene glycol.

The derivatives of the polyhydric alcohols may be enumerated by lower alkylethers of the above-mentioned polyhydric alcohols, such as ethylene glycol dimethylether, and lower carboxylates of the above-mentioned polyhydric alcohols, such as ethylene glycol diacetate. These polyhydric alcohols and derivatives thereof are effective in preventing clogging of nozzles used for printer devices.

Instead of the above-mentioned water-soluble organic solvents, alcohol amines, such as mono-, di- or triethanol amines, amides, such as dimethyl formamide or dimethyl acetoamide, ketones, such as acetone or methylethylketone or ethers such as dioxane.

In the dilution liquids, there may be contained various surfactants, such as pH adjustment agents and mold-proofing agents.

In the ink used in the present invention, the above-mentioned water-soluble organic solvents may be used in addition to the above-mentioned dyes and water.

What is claimed is:

1. A printer device comprising:

a first driving voltage;

a second driving voltage;

an emission medium pressurizing chamber charged by applying the second driving voltage with an emission medium in a stand-by state;

a quantitation medium pressurizing chamber charged by the applying first driving voltage with a quantitation medium in the stand-by state;

an emission medium nozzle communicating with the emission medium pressurizing chamber, the emission medium nozzle having an opening;

a quantitation medium nozzle communicating with the quantitation medium pressuring chamber, the quantitation medium nozzle having an opening;

the emission medium nozzle opening and the quantitation medium nozzle opening being adjacent to each other; and a printer head adapted to ooze the quantitation medium from the quantitation medium nozzle towards the emission medium nozzle in response to a decrease of the first driving voltage and subsequently to emit the emission medium from the emission medium nozzle as the second driving voltage decreases, mix the quantitation medium and the emission medium together, and emit a resulting mixed solution;

wherein, during a time period after emission of the quantitation medium from the quantitation medium nozzle until a liquid surface of the quantitation medium reverts to the opening of the quantitation medium nozzle, the quantitation medium being pressurized in a reverse direction to pull the liquid surface into the quantitation medium nozzle in response to an increase in the first driving voltage.

2. The printer device as claimed in claim 1 further comprising:

pressure control means driven by the first driving voltage controls the pressure applied to the quantitation medium;

wherein, the voltage applied across the pressure control means is a varied increase so that, after emitting the quantitation medium from the quantitation medium nozzle, the quantitation medium will be pressurized in a reverse direction to pull the liquid surface of the quantitation medium towards the inside of the quantitation medium nozzle.

3. A printer device comprising:

a first driving voltage;

a second driving voltage;

an emission medium pressurizing chamber charged, by applying the second driving voltage, with an emission medium in a stand-by state;

a quantitation medium pressurizing chamber charged, by the applying first driving voltage, with a quantitation medium in the stand-by state;

an emission medium nozzle communicating with the emission medium pressurizing chamber, the emission medium nozzle having an opening;

a quantitation medium nozzle communicating with the quantitation medium pressurizing chamber, the quantitation medium nozzle having an opening;

the emission medium nozzle opening and the quantitation medium nozzle opening being adjacent to each other; and a printer head adapted to ooze the quantitation medium from the quantitation medium nozzle towards the emission medium nozzle in response to a decrease of the first driving voltage and subsequently to emit the emission medium from the emission medium nozzle as the second driving voltage decreases, mix mixing the quantitation medium and the emission medium together, and emit a resulting mixed solution;

wherein, during a time period after emission of the emission medium from the emission medium nozzle until a liquid surface of the emission medium reverts to the opening of the emission medium nozzle, the emission medium being pressurized in a reverse direction to pull the liquid surface into the emission medium nozzle in response to an increase in the second driving voltage.

4. The printer device as claimed in claim 3 further comprising:

pressure control means driven by the second driving voltage controls the pressure applied to the emission medium;

wherein, the voltage applied across the pressure control means is a varied increase so that, after emitting the emission medium from the emission medium nozzle, the emission medium will be pressurized in a reverse direction to pull the liquid surface of the emission medium towards the inside of the emission medium nozzle.

* * * * *